US006462008B1

(12) United States Patent
Ortiz et al.

(10) Patent No.: US 6,462,008 B1
(45) Date of Patent: Oct. 8, 2002

(54) DETERGENT COMPOSITIONS COMPRISING PHOTOBLEACHING DELIVERY SYSTEMS

(75) Inventors: Rafael Ortiz, Milford; David Johnathan Kitko, Cincinnati; Michael Eugene Burns, Hamilton; Stephen Wayne Heinzman; Alan David Willey, both of Cincinnati, all of OH (US); Brian Jeffreys, Grimbergen (BE); James Charles Theophile Roger Burckett-St. Laurent, Cincinnati; Phillip Kyle Vinson, Fairfield, both of OH (US); Trace Wendell de Guzman Trajano, Manilla (PH)

(73) Assignee: Case Western Reserve University, Cleveland, OH (US)

( * ) Notice: Subject to any disclaimer, the term of this patent is extended or adjusted under 35 U.S.C. 154(b) by 0 days.

(21) Appl. No.: 09/936,058

(22) PCT Filed: Mar. 1, 2000

(86) PCT No.: PCT/US00/05408

§ 371 (c)(1),
(2), (4) Date: Dec. 21, 2001

(87) PCT Pub. No.: WO00/52122

PCT Pub. Date: Sep. 8, 2000

Related U.S. Application Data

(60) Provisional application No. 60/123,005, filed on Mar. 5, 1999.

(51) Int. Cl.[7] ..... C11D 3/28; C11D 7/32; C11D 7/50; C11D 7/54

(52) U.S. Cl. ..... 510/301; 510/303; 510/304; 510/311; 510/312; 510/370; 510/376; 510/394; 510/500; 510/508; 540/123; 540/128

(58) Field of Search ..... 510/301, 303, 510/304, 311, 312, 370, 376, 394, 500, 508; 540/123, 128

(56) References Cited

U.S. PATENT DOCUMENTS

| | | | | | |
|---|---|---|---|---|---|
| 4,256,597 | A | * | 3/1981 | Sakkab | 252/99 |
| 4,400,173 | A | * | 8/1983 | Beavan | 8/107 |
| 5,817,614 | A | * | 10/1998 | Miracle et al. | 510/376 |
| 5,916,481 | A | * | 6/1999 | Willey | 252/186.21 |
| 5,958,858 | A | * | 9/1999 | Bettiol et al. | 510/351 |
| 6,197,070 | B1 | * | 3/2001 | Horner et al. | 8/137 |
| 6,218,351 | B1 | * | 4/2001 | Busch et al. | 510/311 |
| 6,339,055 | B1 | * | 1/2002 | Brooker et al. | 510/301 |

FOREIGN PATENT DOCUMENTS

| | | | |
|---|---|---|---|
| WO | WO 97/05203 | * | 2/1997 |
| WO | WO 98/32826 | * | 7/1998 |

* cited by examiner

*Primary Examiner*—Gregory Delcotto
(74) *Attorney, Agent, or Firm*—Fay, Sharpe, Fagan, Minnich & McKee, LLP

(57) ABSTRACT

Detergent compositions comprising photobleach delivery systems, processes for preparing them, and their methods of use, the compositions combine selected hydrophobic photobleaches, especially based on Si(IV) phthalocyanines, with selected axial ligands, with certain water-soluble polymers, nonbonded ligands, detersuve surfactants, especially certain mid-chain branched types, and non-surfactant detersive adjuncts.

8 Claims, No Drawings

DETERGENT COMPOSITIONS COMPRISING PHOTOBLEACHING DELIVERY SYSTEMS

This application claims priority under 35 USC 119(e) to 60/123005, filed Mar. 5, 1999.

FIELD OF THE INVENTION

The present invention is in the field of laundry detergents having photobleach systems comprising hydrophobic phthalocyanines and water-soluble polymers. The field includes preparations and methods of use of the compositions to successfully deposit the photobleaches on fabrics despite presence of detersive surfactants which tend to remove these photobleaches.

BACKGROUND OF THE INVENTION

Delivery of photobleaching benefits through laundry detergents is technically difficult. Even when a photobleach is free from multiple issues such as overhueing, poor photophysics, localized staining tendency, unacceptable color, uneven deposition etc., its inclusion and successful delivery to fabrics from a composition which contains detersive surfactants is problematic.

Unlike many other technical fields in which photoactive compounds may easily be used, the field of laundry detergents involves surfactants designed to aggressively clean fabrics, to suspend soil, and not to deposit materials such as photobleaches. Even when many water-soluble polymers and surfactants are known to be useful in detergent compositions, there remains appreciable difficulty to select and combine hydrophobic photobleaches, polymers and surfactants appositely so that the resulting detergent composition delivers a properly performing photobleach system with a minimum of the aforementioned issues, to the fabrics being laundered.

Historically, in efforts to arrive at directly formulatable photobleaches, photobleach types have been developed which include charged groups and/or water-soluble features, such as in the sulfonated zinc phthalocyanines. Since these are charged, water-soluble materials, they differ from non-charged, water-insoluble materials, especially with respect to their interaction with common anionic and nonionic detersive surfactants.

Most recently, certain hydrophobic, non-charged photobleach types have been developed. These include non-charged photobleaches disclosed in WO 98/32832 A, WO 98/32829 A, WO 98/32828 A, WO 98/32827 A, WO 98/32826 A, WO 98/32825 A, and WO 98/32824 A all published Jul. 30, 1998; and WO 97/05203 A and WO 97/05202 published Feb. 13, 1997. Such materials have superior properties as photobleaches. They can, for example, include superoxide generation, or be relatively low-hueing, or can be particularly useful on hydrophobic soils.

It is an object of the present invention to provide improved photobleach delivery systems, especially types wherein the photobleach is hydrophobic; novel laundry detergent compositions comprising such systems; processes for preparing the photobleach delivery systems and/or the final detergent compositions; and methods of use of the formed detergent compositions.

These and other objects are accomplished herein as will be seen from the following disclosure.

BACKGROUND ART

See for example U.S. Pat. No. 5,872,248; U.S. Pat. No. 5,484,778; U.S. Pat. No. 5,763,602; Derwent 93-032275; EP-284,370 A; EP-296,876; EP-366,440; EP-484,027 A; EP 538,228 A; EP-596,184; GB 2,260,996; GB 2,279,657; GB 2,313,122; JP 3285998 (See Derwent 9-038692); JP 51/39044; JP 52/55339; JP 60/48047; JP 61/57536; JP 7292398 A (see Derwent 96-017535); KR 97-61275; KR 9102515 (see Derwent 92-321309); U.S. Pat. No. 3,860,484; U.S. Pat. No. 4,166,718; U.S. Pat. No. 4,209,417; U.S. Pat. No. 4,304,719; U.S. Pat. No. 4,368,053; U.S. Pat. No. 4,800,188; U.S. Pat. No. 4,806,514; U.S. Pat. No. 4,911,919; U.S. Pat. No. 5,135,717; U.S. Pat. No. 5,280,183; U.S. Pat. No. 5,346,670; U.S. Pat. No. 5,437,929; U.S. Pat. No. 5,482,514; U.S. Pat. No. 5,484,778; U.S. Pat. No. 5,561,106; U.S. Pat. No. 5,585,483; U.S. Pat. No. 5,665,689; U.S. Pat. No. 5,665,875; U.S. Pat. No. 5,679,661; U.S. Pat. No. 5,733,560; U.S. Pat. No. 5,824,800; WO 91/18006; WO 91/18007; WO 92/01753; WO 92/01753; WO 94/22960; WO 95/06688; WO 95/24267; WO 95/31526; WO 96/29367; WO 97/05202; WO 97/05202; WO 97/05203; WO 97/10811; WO 98/14521; WO 98/25455; WO 98/32827; WO 98/32832; and WO 98/44052.

See also U.S. Pat. No. 3,094,536, Jun. 18, 1963; U.S. Pat. No. 3,927,967, Dec. 23, 1975; U.S. Pat. No. 4,033,718, Jul. 5, 1977; U.S. Pat. No. 4,240,920, Dec. 23, 1980; U.S. Pat. No. 4,255,273, Mar. 10, 1981; U.S. Pat. No. 4,256,597, Mar. 17, 1981; U.S. Pat. No. 4,318,883, Mar. 9, 1982; U.S. Pat. No. 4,497,741, Feb. 5, 1985; U.S. Pat. No. 4,648,992, Mar. 10, 1987; and U.K. Pat. Appl. 1,372,035 published Oct. 30, 1974; U.K Pat. Appl. 1,408,144 published Oct. 1, 1975; U.K. Pat App. 2,159,516 published Dec. 4, 1985; E.P. 285,965 A2; E.P. 381,211 A2 published Aug. 8, 1990; E.P. 484,027 A1 published May 6, 1992; and Japanese Kokai 06-73397 Derwent Abst. No. (94-128933) published Mar. 15, 1994.

In addition to the above, other references describe the synthesis, preparation and properties of phthalocyanines and naphthalocyanines; see *Phthalocyanines: Properties and Applications*, Leznoff, C. C. and Lever A. B. P. (Eds), VCH, 1989; *Infrared Absorbing Dyes*, Matsuoka, M. (Ed), Plenum, 1990; *Inorg. Chem.*, Lowery, M. J. et al., 4, pg. 128, (1965); *Inorg. Chem.* Joyner R. D. et al., 1, pg. 236, (1962); *Inorg. Chem.*, Kroenke, W. E. et al., 3, 696, 1964; *Inorg. Chem.* Esposito, J. N. et al., 5, pg. 1979, (1966); *J. Am. Chem. Soc.* Wheeler, B. L. et al., 106, pg. 7404, (1984); *Inorg. Chem.* Ford, W. E, et al., 31, pg. 3371, (1992); *Material Science*, Witkiewicz, Z. et al., 11, pg. 39, (1978); *J. Chem. Soc.* Perkin Trans. I, Cook, M. J., et al., pg. 2453, (1988); *J. Chin. Chem. Soc.*, 40, pg. 141, (1993); *J. Inorg. Nucl. Chem.*, 28, pg. 899, (1966); *Polymer Preps*, 25, pg. 234, (1986); *Chem. Lett.*, 2137, (1990); *J. Med. Chem.*, 37, pg. 415, (1994).

SUMMARY OF THE INVENTION

This invention provides a detergent composition with an improved photobleach delivery system. Essential components are (a): a photobleach delivery system, very preferably one combining a mixture of PEG 4,000 and a hydrophobic photobleach such as a nonionic Si(IV) phthalocyanine substituted by nonionic axially bonded ligands, e.g., Silicon Phthalocyanine bis(1 PO/OH glycerol propoxylate), and mixed with an excess of nonbonded PO/OH glycerol propoxylate ligand; (b): a detersive surfactant, very preferably including a mid-chain methyl-branched surfactant, and (c): non-surfactant detergent adjunct.

More generally, the detergent composition comprises (a): a photobleach system consisting essentially of a photoactive mixture comprising (I) a specifically selected water-soluble polymer; (II) a specifically selected hydrophobic photobleach, preferably further comprising a nonbonded ligand as defined hereinafter; and, optionally, (III) an external coating or other encapsulation means.

The amount of the photobleach system in the detergent composition as a whole is from about 0.001% to about 30%, more preferably from about 0.001% to about 10%, more preferably still from about 0.01% to about 5%.

Expressed on the basis of the photobleach system taken alone before mixing into the detergent composition, there is present in the photobleach system, by weight, from about 0.01% to about 30%, more preferably from about 0.1% to about 15%, more preferably still from about 1% to about 5% of hydrophobic photobleach compound, from about 30% to about 99.9%, more preferably from about 70% to about 90%, more preferably still from about 80% to about 85% water-soluble polymer, and, when present, at least about 0.001%, more typically from 0.01% to about 60% preferably from about 1% to about 20%, more preferably still from about 5% to about 15% of nonbonded ligand in the photobleach system; (the units of parts per million; 1 ppm=1 milligram per liter=0.0001% by weight may alternatively be used herein from time to time, especially for content of photobleach component in the photobleach system or in the detergent composition).

Expressed on the basis of the amount of the components of the photobleach system in the detergent composition as a whole, there is present in the detergent composition, by weight, from about 0.015 ppm to about 0.5%, more preferably from about 0.010% to about 0.050%, more preferably still from about 0.001% to about 0.01% of hydrophobic photobleach compound, at least about 0.001%, more preferably from about 0.01% to about 25%, more preferably and typically from about 0.05% to about 0.5% water-soluble polymer, and, when present, at least about 0.0001%, more typically from 0.001% to about 1%, preferably from about 0.005% to about 0.1% of nonbonded ligand in the detergent composition.

The detergent composition also comprises (b): from about 0.1% to about 95%, more preferably from about 0.5% to about 50%, typically from about 1% to about 30% by weight of the detergent composition of at least one detersive surfactant, preferably a biodegradably (mid-chain) branched surfactant.

The detergent composition also comprises (c): from about 0.0001% to about 99%, more preferably from about 1% to about 90%, typically from about 20% to about 85% by weight of the detergent composition of at least one non-surfactant detergent adjunct other than (a) or (b).

In one preferred embodiment, (i), the photoactive mixture or photobleach delivery system of the detergent composition comprises the water-soluble polymer and a member selected from the group consisting of: mixtures of non-charged hydrophobic photobleach compounds and nonbonded ligands, wherein said nonbonded ligands are selected from the group consisting of compounds capable of binding axially to a Si, Al, Ga, Ge or Sn phthalocyanine moiety and said photobleach compounds are selected from the group consisting of Si, Al, Ga, Ge and Sn phthalocyanines, preferably Si phthalocyanines or Al phthalocyanines, having a bonded ligand in at least one axial position and having solid form at ambient temperature in the absence of impurities. In this embodiment, it has been discovered, nonbonded ligand appears to prevent crystallization of the photobleach and makes it unexpectedly superior for incorporation with the water-soluble polymer; the photobleach compound, the nonbonded ligand, and the water-soluble polymer together acting as a photobleach delivery system for use with surfactants in a detergent composition in accordance with the invention.

In another embodiment, (ii), it is required that the photobleach active material be selected from the group consisting of non-charged hydrophobic photobleach compounds having melting-point below about 95° C., preferably from about 35° C. to about 80° C. The relatively low melting-point makes the photobleach unexpectedly superior for incorporation with the water-soluble polymer; the low-melting photobleach compound, the nonbonded ligand, and the water-soluble polymer together act as a photobleach delivery system for use with surfactants in a detergent composition in accordance with the invention. It should be noted that no such low-melting photobleach system for detergents is known in the art. This is partly on account of the fact that, until very recently, all photobleaches used in detergents were ionic compounds, e.g., sulfonated salts. Such materials have much higher melting points typical of ionic solids.

In yet another embodiment, (iii), it is required that the photobleach be selected from the group consisting of non-charged (i.e., nonionic) hydrophobic photobleach compounds having crystalline form and having a mean crystal size of below about 30 microns, preferably from about 0.001 to about 10 microns.

The invention has many other ramifications and embodiments, and many advantages, as will be seen from the following disclosure. All percentages and proportions herein are by weight unless otherwise indicated. All documents cited herein are incorporated by reference in their entirety.

DETAILED DESCRIPTION OF THE INVENTION

A. Detergent Composition

The present invention encompasses detergent compositions for laundering soiled garments or fabrics in automatic washing machines or by hand. A "detergent composition" is a composition having any suitable form, such as granules, powders, tablets, liquids, gels, pastes, bars or the like, and comprising an effective amount of at least one detersive surfactant capable of removing soils from soiled clothing and an effective amount of least one non-surfactant detergent adjunct.

An "effective amount" of a detersive surfactant is an amount capable, when the composition is used to clean fabrics, of at least partially improving the appearance thereof by removal of soil, especially greasy or particulate soil. Typical "effective amounts" of detersive surfactants are amounts consistent with exceeding the critical micelle concentration of a single detersive surfactant under the conditions of use, or, when multiple detersive surfactants are used, the in-use concentration of the combination of detersive surfactants is sufficient for forming micelles.

A "detersive surfactant" is an amphiphilic compound, typically at least partially water-soluble, preferably completely water-soluble. having at least one hydrophobic moiety, called a "tail", typically comprising a linear or branched hydrocarbyl moiety comprising at least six carbon atoms, and at least one hydrophilic moiety, called a "head-group". The head-group may be charged or non-charged.

A "non-surfactant detergent adjunct" is any component suitable for incorporation in a laundry detergent provided that this component is other than a detersive surfactant or a photobleach system. Such a component can include, for example, builders, chelants, bleach systems, soil release polymers, softeners, perfumes or pro-perfumes and the like. Preferred non-surfactant detergent adjuncts include bleach systems, (especially those comprising hydrophobic bleach activators such as nonanoyloxybenzene sulfonate and/or transition metal bleach catalysts such as Mn or Fe complexes of rigid macrocyclic donors and/or organic bleach boosters), enzyme systems (including both bleaching and non-bleaching enzymes), builders (including sodium tripolyphosphate as well as nonphosphate detergency builders, such as zeolites), silicone/silica compounded antifoams, end-capped terephthalate-based soil release polymers, optical brighteners, and pro-perfumes.

B. Overview of Components

In addition to the detersive surfactant and non-surfactant detergent adjunct, the present invention requires that the detergent compositions comprise an effective amount of a photobleach system.

An "effective amount" of a photobleach system is any amount of a photobleach system capable of improving the appearance of laundered fabric through any photophysical mechanism, be it catalytic or stoichiometric. The improvement may happen in the washing or laundering stages, or in subsequent stages, such as line drying in the sun. "Effective amounts" of photobleach in a laundry detergent composition can be very low, e.g., as low as about 0.01 ppm.

C. Photobleach System

Detergent compositions of the invention comprise, as an essential component, a photobleach system. The photobleach system is in the form of a photoactive mixture which generally includes a specific type of photobleach compound and a specific water-soluble polymer. The preferred photobleach compounds have no charged moieties, i.e. they are "nonionic", and they are metal or metalloid phthalocyanines comprising one or two chemically bound ligands occupying axial positions. In preferred embodiments, the photobleach system further comprises a ligand physically, rather than chemically combined with the photobleach and water-soluble polymer. This is referred to herein as "excess ligand" or "nonbonded ligand". The photobleach can include other optional components, for example certain external coatings and/or cationic additives. The photobleach system however preferably excludes water and/or common organic solvents other than certain alcohols which can be used as the ligand component.

Accordingly the invention encompasses a detergent composition having an improved photobleach delivery system, said detergent composition comprising (a) at least about 0.001% of a photoactive mixture of: (I) at least about 0.001% of a water-soluble polymer and (II) at least about 0.015 ppm of a photobleach selected from the group consisting of: (i) mixtures of at least about 0.015 ppm of non-charged hydrophobic photobleach compounds and at least about 0.001% of nonbonded ligands, wherein said nonbonded ligands are selected from the group consisting of compounds capable of binding axially to a Si, Al, Ga, Ge or Sn phthalocyanine moiety and said photobleach compounds are selected from the group consisting of Si, Al, Ga, Ge and Sn phthalocyanines having a bonded ligand in at least one axial position and having solid form at ambient temperature in the absence of impurities; (ii) at least about 0.015 ppm of non-charged hydrophobic photobleach compounds having melting-point below about 95° C.; (iii) at least about 0.015 ppm of non-charged hydrophobic photobleach compounds having crystalline form and having a mean crystal size of below about 30 microns; and (iv) mixtures thereof; (b) from about 0.1% to about 95% of at least one detersive surfactant; and (c) from about 0.0001% to about 99% of at least one non-surfactant detergent adjunct other than (a) or (b). Preferred levels, both in terms of amounts of the photobleach system components and in terms of amounts of all components in the detergent composition as a whole, are given in the summary.

In a preferred detergent composition, said photobleach compound is present as said photoactive mixture of (I) and (II)(i), wherein said water-soluble polymer and said photobleach compound are at a ratio by weight of from about 2,500:1 to about 1:10; more preferably from about 60:1 to about 20:1; wherein said said nonbonded ligand and said photobleach compound are at a ratio by weight of from about 100:1 to about 1:1,000, preferably from about 50:1 to 1:1, e.g., about 4:1; wherein said detergent composition comprises from 0.001% to 0.010% of said photobleach compound, and wherein said photobleach consists essentially of: (A) a metal or metalloid selected from Si and Al; (B) a chromophore selected from phthalocyanine and naphthalocyanine (preferably phthalocyanine), optionally substituted provided said photobleach is not thereby rendered substantially soluble in water (and preferably completely excluding sulfonated phthalocyanines) and (C) one or two of said bonded ligands, in axial position. In other preferred detergent compositions, said photobleach compound is present as said photoactive mixture of (I) and (II)(ii), or of (I) and (II)(iii).

In a highly preferred detergent composition according to the invention, said photobleach compound is a nonsulfonated, nonsalt photobleach and said water-soluble polymer is present at level of from about 0.05% to about 0.5% by weight of the detergent composition and wherein said nonbonded ligand is present at a level of from about 0.005% to about 0.1% by weight of said detergent composition.

In terms of ratios, a preferred level of nonbonded ligand to total water-soluble polymer is from about 1 to 1,000 to about 1 to 2, typically 1:10 by weight.

C 1. Water-Soluble Polymer

C 1.1. General Characteristics of the Water-Soluble Polymer

C 1.1.1. Water-solubility of the Water-Soluble Polymer

The term "water-soluble" used in conjunction with the water-soluble polymers means that these are polymers capable of substantially complete dissolution in water at at least one temperature in the range from about 4° C. to about 100° C. "Substantially" complete means that, at at least one temperature in said range, it is possible to put one part by weight of the water-soluble polymer into one hundred parts by weight deionized water, to stir for any suitable period, for example one hour to dissolve the water-soluble polymer, and to filter the resulting solution through a 1 micron filter, to examine the filter, and to find less than 0.1%, preferably less than 0.01% residue on the filter.

In an alternative test, a light source, such as a laser, even an inexpensive laser pointer, may be used to confirm that under the test condition, the water-soluble polymer in water, in the absence of any other component of the photobleach system, produces no appreciable light scattering that would be consistent with undissolved water-soluble polymer.

"Water soluble" as used herein is not generally intended to imply that all acceptable water-soluble polymers must exhibit no cloud point phenomenon whatever. That is, an acceptable water-soluble polymer may be fully water-soluble at one temperature in said range yet at least partially insoluble and capable of producing a light-scattering solution at another.

Nonetheless, in preferred embodiments, the water-soluble polymer is both water-soluble and free from cloud-point phenomena at temperatures in the range from about 20° C. to about 90° C.

"Water-soluble polymers" herein are moreover generally to be distinguished from water-swellable but insoluble polymers which are unacceptable as the water-soluble polymer component, and from common nonionic detersive surfactants, such as compounds having the formula $C_{10}$–$C_{18}$ $(CH_2CH_2O)_xH$ wherein x is a number, typically from 1 to 20. Such detersive surfactants may instead be used as examples of the detersive surfactant component of the invention, not as the "water-soluble polymer" of the photobleach system. This point of clarification is made because these common nonionic detersive surfactants are unsuitable as the water-soluble polymer component. These common nonionic detersive surfactants are, confusingly, sometimes called "polymers" in the art because they comprise more than one unit of ethylene oxide. What distinguishes such materials from the essential water soluble polymers herein is that the former are not only water soluble, but also substantially comicellizable with other common detersive surfactants such as alkylbenzene sulfonates and alkyl sulfates. In contrast, the water-soluble polymers herein lack the amount of amphiphilic character that would render them substantially comicellizable with such detersive surfactants. Such lack of appreciable comicellization with common detersive surfactants is a critical feature of the water-soluble polymer selection in the present invention. This is not to be taken to exclude absolutely all interaction, for example NMR can be used to demonstrate at least some interaction of LAS micelles and certain water-soluble polymers which are acceptable for use herein.

The term "water-soluble" as used in conjunction with the essential water-soluble polymers, therefore, is in a sense used to reinforce not only the water-soluble property, but also to distance these polymers from any common nonionic detersive surfactants that, by virtue of their appreciable permanent amphiphilicity and presence of long-chain hydrophobic groups, dissolve into micelles of other common detersive surfactants.

As described in "Surfactants and Polymers in Aqueous Solution", Jonsson et al., Wiley & Sons, 1998, it is known that a polymer is not soluble in certain liquids where there exists a large difference in the interaction energy between segments of the polymer and solvent molecules as compared to the interaction energy between segment-segment and solvent-solvent molecules. It is further known (Physical Properties of Polymers Handbook, Ed. J. E. Mark, AIP Press, 1996; Handbook of Polymer-Liquid Interaction Parameters and Solubility Parameters, A.F.M. Barton, CRC Press, 1990) that the solubility parameter, also known as the Hildebrand parameter, provides a simple method of correlating and predicting the cohesive and adhesive properties of materials from a knowledge of the properties of the components only. Therefore, solubility parameters are often used to predict polymer-solvent and polymer-polymer equilibria. The solubility parameter for water is 47.9 $MPa^{1/2}$, whereas the solubility parameter for a hydrophobic material like hexane is 14.9 $MPa^{1/2}$. The solubility parameter for polyethylene glycol 4,000, an especially useful water-soluble polymer herein, at 25° C. is in the range from 18.9 to 22.5 $MPa^{1/2}$. Water-soluble polymers selected for use herein preferably have solubility parameters in the range from about 15 to about 42 $MPa^{1/2}$, preferably 16 to 35 $MPa^{1/2}$, more preferably 17 to 30 $MPa^{1/2}$. Other suitable carriers include glycerol propixylates having an average molecular weight from 200 to 1000 daltons.

C 1.1.2. Thermoplasticity, Melting Ranges and Glass Transition Temperatures of Water-Soluble Polymer Water-soluble polymers selected for use herein are generally thermoplastic, that is, their viscosity reduces to the point that they become flowable as temperature is increased. Preferred water-soluble polymers are those thermoplastic water-soluble polymers which are solid at room temperature but that become molten or fluid below about 100° C., more preferably those that are molten or fluid at temperatures in the range from about 4° C. to about 95° C., more typically from about 35° C. to about 80° C., i.e., in common wash water conditions (it not being intended to exclude certain countries, such as Japan, where wash water temperatures can sometimes be above 4° C. but very low.)

In terms of glass transition temperatures a range that is especially useful for the water-soluble polymer herein is the glass transition temperature range associated with polyethylene glycols having molecular weights in the range from about 1,000 to 10,000, as is documented in the literature, see for example Kirk Othmer's Encyclopedia of Chemical Technology. Water-soluble polymers other than polyethylene glycols and having this range of glass transition temperature can be equally useful. However, other water-soluble polymers that can be used may have appreciably higher glass transition temperatures, for example as in PVP.

C 1.1.3. Charge of Water-Soluble Polymer

The water-soluble polymers forming an essential component of the present invention may optionally include limited, e.g., less than about 0.3 mole fraction, preferably less than about 0.1 mole fraction, of monomers or moieties providing an anionic or cationic charge on the water-soluble polymer at laundry pH (typically from about 6 to about 12 including liquid detergents, more typically from about 8 to about 11, especially for granular detergents). However, anionic charge is generally undesirable since it tends to prevent deposition on fabrics and cationic charge can also in certain circumstances be undesirable, especially when it results in strong interaction with anionically charged detersive surfactants.

It is not intended to exclude water-soluble polymers which have anionic charge, while remaining water-soluble and compatible with the detersive surfactant system as measured in the tests hereinafter. Moreover, when the detersive surfactant is carefully selected, for example in the case of a detergent composition comprising a substantially nonionic detersive surfactant and not having appreciable amounts of anionic detersive surfactant present, the invention actually includes embodiments wherein cationic charge may be added to the photobleach delivery system by any suitable means, for example through the inclusion of a cationic monomer in the water-soluble polymer, or through the inclusion of an optional cationically charged material of any kind, in the photobleach delivery system.

C 1.1.4. Hydrophobicity of Water-Soluble Polymer

The water-soluble polymers forming an essential component of the present invention may optionally include limited proportions of hydrophobic moieties such as relatively short, e.g., $C^1$–$C_8$, preferably $C^1$–$C_4$ alkyl moieties, optionally in amide, ether or ester side-chains, provided that they remain water-soluble. The introduction of appreciable permanent hydrophobicity, e.g., via $C_{12}$–$C_{20}$ side-chains, is however highly undesirable for the purposes of the present invention to the extent that it increases interaction with the detersive surfactant and/or creates highly viscous phases which are undesirable.

It is not intended to exclude water-soluble polymers which do have at least nominal hydrophobicity, while remaining water-soluble and forming mixtures with the photobleach which are appreciably not destroyed by the detersive surfactant under wash conditions.

C 1.1.5. Water-Soluble Polymer: Homo-, co- and Terpolymers

The water-soluble polymers forming an essential component of the present invention can vary quite broadly in terms of the polymerized monomers that they contain. Preferred monomers will provide substantial hydrophilicity without providing permanent anionic charge. Thus preferred monomers exclude the many common highly carboxylated types, such as common polyacrylates. Such polyacrylates are of course common optional non-surfactant adjuncts of detergents and can be used as such herein.

The water-soluble polymers can be a homopolymer, comprising a single type of polymerized monomeric unit, or a co-polymer, comprising two or more different polymerized monomeric units. Homo- and copolymers can be terminated or end-capped by monovalent monomers provided that the combination of monomers does not render the polymer water-insoluble. A particular type of copolymer which can be used is a terpolymer, comprising three different polymerized monomeric units.

In general, the monomers can be polymerized by any known polymerization technique and can be used to form an essentially linear polymer, or alternatively, to form any other water-soluble structure, such as so-called "comb" structures, or structures based on polymerization onto a low proportion of a polyvalent monomer, forming for example, a "T" or an "H" at the center of the polymeric structure. Other structures may include starburst structures, dendrimeric structures, fractal structures or the like, provided that the polymer remains water-soluble.

C 1.1.6. Molecular Weight of Water-Soluble Polymer

The water-soluble polymers forming an essential component of the present invention can vary in terms of molecular weight provided that they remain water-soluble. The water-soluble polymer can in general have a number average molecular weight that varies widely, e.g., from about 500 to 1,000,000, more preferably from 1,000 to 100,000, more preferably still, from about 1,000 to 10,000.

Preferred molecular weights avoid the low end of the range because at this end, there is an increased risk that the water-soluble polymer will simply dissolve in wash water leaving the hydrophobic photobleach with no delivery system, and vulnerable to being absorbed into micelles of the detersive surfactant.

Preferred molecular weights avoid the high end of the range because of a tendency to increase viscosity and decrease capability for internal diffusion of the photobleach in the water-soluble polymer.

Unless otherwise noted, molecular weights of polymers herein are number average molecular weights, $M_n$. When a polymer provided by a specific supplier is referenced, the molecular weight may be as defined by the supplier, i.e., weight average or number average.

C 1.1.7. Crosslinking of Water-Soluble Polymer

All preferred water-soluble polymers forming an essential component of the present invention in general have at most low levels of, or preferably are substantially free from, or completely free from, crosslinking. Crosslinking strongly reduces water-solubility. It is not intended to exclude water-soluble polymers which have nominal crosslinking, while remaining water-soluble.

C 1.1.8. Impurity of Water-Soluble Polymer

Common water-soluble polymers can contain impurities, such as residual monomer, and can contain varying amounts of moisture. Preferred water-soluble polymers herein typically have a purity of 90% or greater, and at most low levels, e.g., less than about 0.1%, or reducing impurities.

Highly preferred water-soluble polymers will be anhydrous or near-anhydrous at the point at which they are being combined with the photobleach to form the photobleach delivery system. When the water-soluble polymer is a polyalkylene glycol, such as polyethylene glycol, it is found preferable herein to use a polyalkylene glycol which has a purity of at least about 99%, preferably at least about 99.5%; such water-soluble polymer preferably contains no more than about 0.01% acetaldehyde impurity and no more than about 0.03% water as impurity.

C 1.2. Function of the Water-Soluble Polymer

As noted in conjunction with describing important features of the selected water-soluble polymers hereinabove, the water-soluble polymer provides a potent delivery system for the photobleach. On one hand, the delivery system protects the hydrophobic photobleach herein from the detersive surfactant which, due to its hydrophobicity, would otherwise treat it as a common "hydrophobic soil" and prevent its deposition. On the other hand, the delivery system provides good uniform deposition, permits the photobleach to interact appropriately with the fabric being washed or the dingy soil thereon, and does not "trap" the photobleach to an extent that would prevent it from performing its function. The photobleach is believed to partition from the water-soluble polymer into the dingy soils on the fabric.

C 1.3. Water-Soluble Polymer Examples

A preferred group of water-soluble polymers for use as an essential component in the present photobleach delivery systems are water-soluble polymers which consist essentially of C, H and O, which are liquid or molten at temperatures less than about 95° C.; more highly preferred compounds of this group being free from hydrophobic $C_x$ chains having more than about x=8 carbon atoms. This group includes especially polyalkylene glycol materials such as:

A) Polyalkylene glycols and/or mixed polyalkylene glycols having average molecular weights of from about 150 to about 20,000, preferably between about 600 and about 10,000, more preferably still from about 3,000 to about 6,000, e.g., about 4,000. Examples include:

polyethylene glycols, preferably having molecular weights of from about 1,000 to about 9,000, more preferably from about 1,400 to about 5,000 (the term "PEG" may be used herein from time to time as an abbreviation for "polyethylene glycol);

polypropylene glycols, preferably having molecular weights of from about 600 to about 4,000;

poly(tetramethylene glycol), preferably having molecular weights of from about 1,000 to about 10,000;

mixed polyalkylene glycols such as poly(ethylene oxide/propylene oxide), for example a poly(ethylene oxide/propylene oxide) having average molecular weight of about 1,100 and a ratio of ethylene oxide units to propylene oxide units (E/P) of about 0.15; a poly(ethylene oxide/propylene oxide) having average molecular weight of about 3,440 and a ratio of ethylene oxide units to propylene oxide units (E/P) of about 0.33; a poly(ethylene oxide/propylene oxide) having average molecular weight of about 1,100 and a ratio of ethylene oxide units to propylene oxide units (E/P) of about 0.15; a poly(ethylene oxide/propylene oxide) having average molecular weight of about 2,920 and a ratio of ethylene oxide units to propylene oxide units (E/P) of about 0.8; a poly(ethylene oxide/propylene oxide) having average molecular weight of about 13,333 and a ratio of ethylene oxide units to propylene oxide units (E/P) of about 3.0; a poly(ethylene oxide/propylene oxide) having average molecular weight of about 8,750 and a ratio of ethylene oxide units to propylene oxide units (E/P) of about 5.0; mixed polyalkylene glycol block copolymers such as $HO[CH_2CH_2O]_x[CH_2CH(CH_3)O]_y[CH_2CH_2O]_xOH$ and/or $$HO[CH_2CH(CH_3)O]_y[CH_2CH_2O]_x[CH_2CH(CH_3)O]_yOH$$

wherein the sum of the y's ranges from about 15 to about 70, and the ratio of the sum of the x's to the sum of the y's is from about 1:10 to about 10:1, preferably from about 1:2 to about 1:1. Examples include materials made by BASF corporation and sold under the tradenames of Tetronic® and Tetronic R® respectively;

(B) $C_1$–$C_8$ alkylated polyalkylene glycols or poly (alkylene glycol) mono- and dialkyl ethers, $RO(R^2O)_nH$ and/or $RO(R^2O)_nR$; wherein each R is $C_{1-C8}$ alkyl, preferably methyl, ethyl, propyl or butyl; each $R^2$ is a $C_2$–$C_4$ alkylene group, and n ranges from 1 to about 200, with the percentage of polyalkylene glycol by weight of the compound preferably being greater than about 70%. Specific examples include:

$RO[CH_2CH(CH_3O)]_mH$ wherein R is methyl, ethyl, propyl or butyl, preferably methyl; and m is from about 1 to about 200 (molecular weight from about 90 to about 20,000);

$RO(CH_2CH_2O)_nH$, with each R being methyl, ethyl, propyl, or butyl, preferably methyl; and n being from about 2 to about 200 (molecular weight from about 120 to about 9,000), preferably from about 15 to about 150 (molecular weight from about 700 to about 6,700), more preferably from about 15 to about 100 (molecular weight from about 700 to about 4,500); and/or $RO(CH_2CH_2O)_nR$, with each R being methyl, ethyl, propyl or butyl; and n being from about 2 to about 200 (molecular weight from about 700 to about 6,700), more preferably from about 15 to about 100 (molecular weight from about 700 to about 4,500);

(C) Polyalkoxylated materials having an average molecular weight of from about 200 to about 20,000 and the weight percent of the polyalkoxy portion being from about 50% to about 99%. Specific examples include Tetronic® and Tetronic R®. Tetronic® and Tetronic R® are block polymeric materials manufactured by BASF Corp. Tetronic® materials have the general formula:

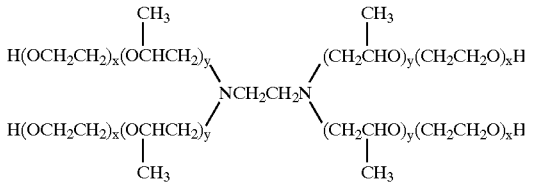

and Tetronic R® materials have the general formula:

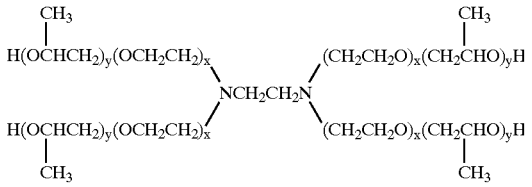

wherein the sum of the y's ranges from about 8 to about 120, and the ratio of the sum of the x's to the sum of the y's is from about 1:10 to about 11:10, preferably from about 1:2 to about 1:1;

Specific examples are:

polyethylene glycols with an average molecular weight of from about 600 to about 20,000;

poly(tetramethylene glycols) with an average molecular weight of from about 1,000 to about 10,000; and poly(ethylene glycol) methyl ether with an average molecular weight of from about 500 to about 20,000.

Other analogs of water-soluble polymers of the above types may include varying numbers of butylene oxide moieties; or water-soluble polymers based on $C_1$–$C_4$ alkylene oxide modifications of certain acetylenes, available from Air Products.

Another group of suitable water-soluble polymers for use herein is the poly(vinyl alcohols), especially those having molecular weight in the range from about 300 to about 20,000.

Another preferred group of water-soluble polymers for use as an essential component in the present photobleach delivery systems are water-soluble polymers which include N as an amide, which are liquid or molten at temperatures less than about 95° C.; more highly preferred compounds of this group being free from hydrophobic $C_x$ chains having more than about 8 carbon atoms. This group includes especially:

Water-soluble polymers comprising as monomeric units vinylamides such as N-vinylpyrrolidone and N-vinylacetamide as well as vinyl heterocycles such as N-vinylimidazole, N-vinyloxazolidone, N-vinyltriazole, 4-vinylpyridine, and 4-vinylpyridine-N-oxide; or poly-(N-isopropyl acrylamide).

Most preferred water-soluble polymer compounds in this group in accordance with this invention are polyvinylimidazole (PVI), or a copolymer of polyvinylpyrrolidone and polyvinylimidazole (PVPVI), most preferably polyvinylpyrrolidone (PVP). Preferably, these highly preferred water-soluble polymers have an average molecular weight of from 20,000 to 60,000.

Also suitable herein as the water-soluble polymer are mixtures of two or more of any of the foregoing water-soluble polymers.

C 2. Photobleach Compound

C 2.1. Photoactive Mixture

The detergent compositions of the invention comprise a photobleach system based on a photoactive mixture containing, at a minimum, the above-identified water-soluble polymer and a hydrophobic photobleach compound. In general a photoactive mixture" is any mixture comprising the essential water-soluble polymer and hydrophobic photobleach compound components provided that the mixture remains capable of photobleaching when contacted on a photobleachable fabric.

C 2.2. Hydrophobic Photobleach Compound

The present photobleach systems comprise a hydrophobic photobleach compound as an essential component. The term "hydrophobic" is used in conjunction with the photobleaches to distinguish the photobleaches herein from "hydrophilic" photobleaches which are well-known in the art: these hydrophilic photobleaches generally comprise at least one anionically charged group, such as a sulfonate group, which confers water-solubility.

The present photobleaches are generally hydrophobic, to the extent that when placed in a two-phase mixture of water and common organic solvents such as methylene dichloride, they will preferentially partition into the organic phase, not the water phase. Preferred hydrophobic photobleach compounds herein are non-charged, or "nonionic".

All highly preferred photobleaches herein are sufficiently hydrophobic to partition at least partially from a phase which is more hydrophilic than triolein, into triolein.

Further disclosures of photobleach compounds suitable for use herein provided that only hydrophobic or non-charged materials are selected, are to be found in commonly assigned WO 98/32832 A, WO 98/32829 A, WO 98/32828 A, WO 98/32827 A, WO 98/32826 A, WO 98/32825 A, WO 98/32824 A, WO 97/05203 A and WO 97/05202.

C 2.2.1. Chromophore

Photobleaches herein generally comprise a chromophore in the form of a planar or distorted-planar extended cyclic system acting as a polydentate ligand occupying equatorial positions with respect to a metal or metalloid. Together, the chromophore, the metal or metalloid and one or two additional ligands occupying axial positions form a photoactive compound. Preferred chromophores are selected from unsubstituted phthalocyanine and naphthalocyanine (preferably phthalocyanine). Optionally, substituents may be attached to the cyanine provided said photobleach is not thereby rendered substantially soluble in water. Substituents, if present, are preferably noncharged; in any event sulfonate substituents are excluded from all preferred embodiments.

C 2.2.2. Metal or Metalloid

Photobleaches herein generally comprise a metal or metalloid selected from the group consisting of Si, Al, Ga, Ge and Sn, more preferably Si and Al, more preferably still, Si. The metal or metalloid, shown as "M" in the following structures, is bound to both to the chromophore and to ligands occupying axial positions, marked X or X' in these structures.

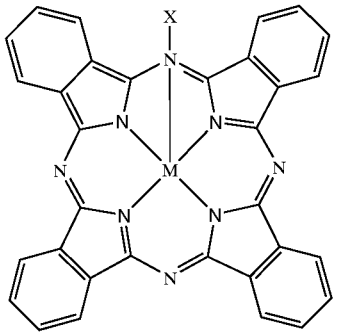

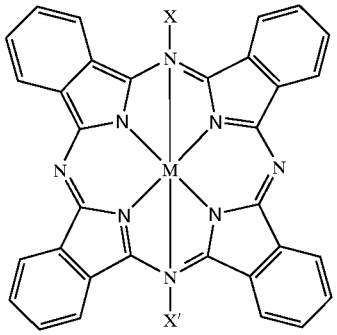

In highly preferred detergent compositions of the invention, the photobleach compound is selected from the group consisting of:

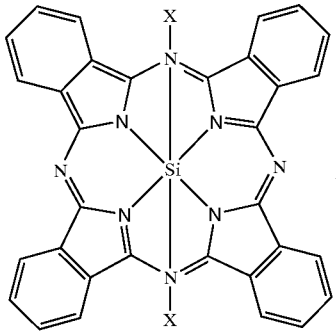

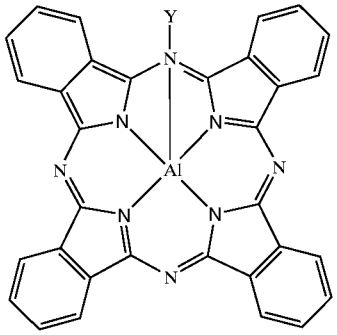

and mixtures thereof wherein X and Y can vary independently and represent bonded ligands and wherein preferred ligands include those identified in the section of the specification "Ligand Examples" and in the Synthesis Examples hereinafter. The valence marked "*" in any of said structures, for example as shown in the Synthesis Examples, is bonded in axial position as indicated by said positions "X" or "Y".

C 2.2.3. Photobleach Precursor

Photobleaches herein are commonly prepared from a precursor compound. A common precursor is the dihydroxy Si(IV) phthalocyanine of formula:

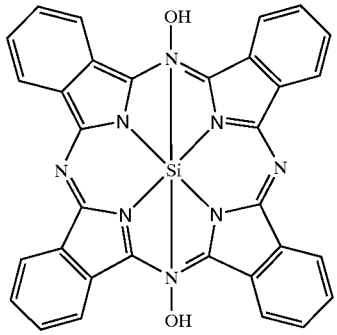

C 2.2.4. "Ligand", Axial Position, Axial Site Available, "Axial Ligand", "Bonded Ligand", "Nonbonded Ligand"

The term "ligand" herein most generally refers to an organic compound other than phthalocyanine or naphthalocyanine (thus specifically excluding inorganic moieties such as water, —OH, —Cl etc. as in the precursor compound above). The ligand is an organic compound capable of binding axially to a Si, Al, Ga, Ge or Sn (preferably Si(IV)) phthalocyanine moiety. The invention does not exclude Si(IV) phthalocyanines comprising one organic axial ligand and one —OH ligand, but preferably, when the metalloid is Si, the photobleach will have two non-OH organic ligands.

Preferred ligands herein have molecular weight of below about 500.

The terms "bonded ligand" or "axial ligand" or "ligand in axial position" herein are used to distinguish ligand which is actually chemically bonded to the metal or metalloid, from ligand which is simply present in physical admixture with the metal or metalloid compound.

The term "axial" as in "axial position", or "axial ligand", is used herein to indicate a position of bonding with respect to a metal or metalloid. Specifically, in the case of phthalocyanine compounds for example, the phthalocyanine chromophore occupies "equatorial positions" while all non-phthalocyanine ligands occupy "axial positions". In Si(IV) phthalocyanines there are two axial positions, whereas in Al phthalocyanines, there is only one. Thus, a "bonded axial ligand" is by definition a ligand, other than the chromophore, bonded to the metal or metalloid.

The term "nonbonded ligand" or "excess ligand" are used herein to distinguish ligand which is physically mixed with the metal or metalloid compound from ligand which is bonded.

On bonding to the photobleach precursor, a ligand molecule may lose a small portion of its mass, for example due to elimination of water or a silanol on reaction with a hydroxyfunctional photobleach precursor. For example when the molecule eliminated is water, the bonded ligand has a molecular weight of 1 less than that of the free or nonbonded ligand.

C 2.2.5. Crystallinity Disruption

In one group of photobleach compositions useful herein, the ligands are substantially crystallinity disrupting by virtue of branching or dissymmetry. To define and illustrate "crystallinity disrupting", note that when a ligand is based on modification of a low molecular weight polyol, such modification when accomplished with a glycol having a methyl side-chain, such as propylene glycol, disrupts the crystallinity of the ligand or its tendency to pack in a crystal as compared with a modification based on ethylene glycol. Likewise, dissymmetric ligand structures can help reduce crystallinity of a metal or metalloid phthalocyanine when the ligand is bonded to the metal or metalloid in an axial position. To further illustrate, the following ligand structure reduces the crystallinity of a metal or metalloid phthalocyanine when it is bonded thereto:

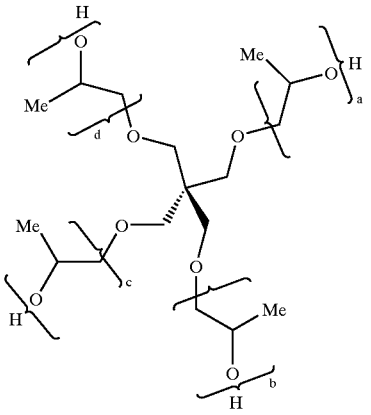

the comparison being made relative to the analog lacking the methyl side-chains.

In another example, the following ligand structure is crystallinity disrupting by virtue of branching or dissymmetry:

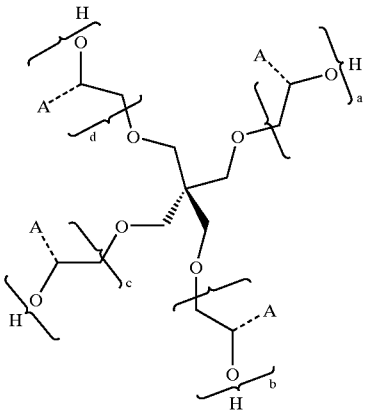

wherein each A can very independently and is selected from the group consisting of H and $CH_3$; and a,b,c and d are numbers provided that the number average molecular weight, $M_n$ is from about 201 to about 1001, preferably about 201–501. (Note that these molecular weights are one hydrogen atom greater than those for the corresponding bonded form of the ligand). In this case, dissymmetric structures occur depending on whether A is H or Methyl.

More generally, a ligand having the structure:

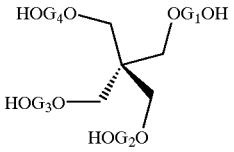

will be crystallinity disrupting by virtue of branching or dissymmetry when one or more of the moieties $G_1$–$G_4$ differs from the others, preferably to a greater rather than a lesser extent; or one or more, but preferably not all, of $G_1$–$G_4$ contains a branching group.

Moreover, crystallinity disruption of a metal or metalloid phthalocyanine can occur through the impact of a bonded ligand, or through the impact of a non-bonded ligand. The greatest impact occurs when the ligand is bonded to the photobleach, and, when the photobleach relies on a nonionic framework, such as unsubstituted M.PC where M is a metal such as Al or Si and PC=phthalocyanine, the resulting structure will have a low melting-point.

C 2.3. Ligand Examples

Preferred ligands herein can in general vary between the bonded ligand and the non-bonded or excess ligand. However in preferred detergent compositions, all of said bonded and non-bonded ligands in a given inventive photobleach delivery system or derivative detergent composition are selected from a group of like ligands. One such preferred group is the group consisting of polyhydroxy ligands. Another such preferred group is the group consisting of aminofunctional ligands. Also acceptable are mixtures of polyhydroxy ligands and aminofunctional ligands.

In highly preferred detergent compositions herein, all ligands are selected from the group consisting of:

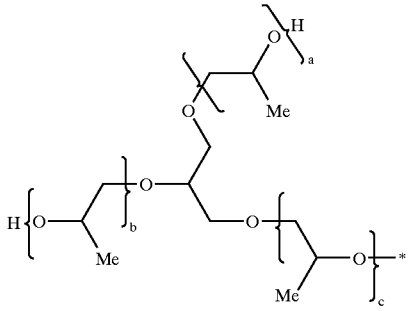
wherein a+b+c is from 0 to 16, preferably from 2 to 4;
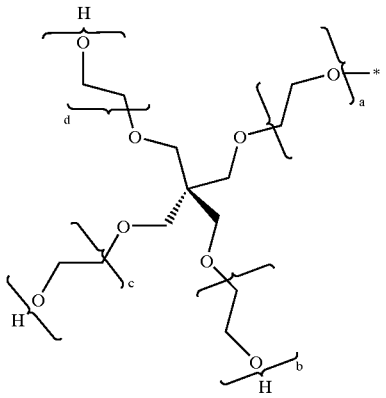
wherein a+b+c+d is from 0 to 16, preferably 2 to 16;
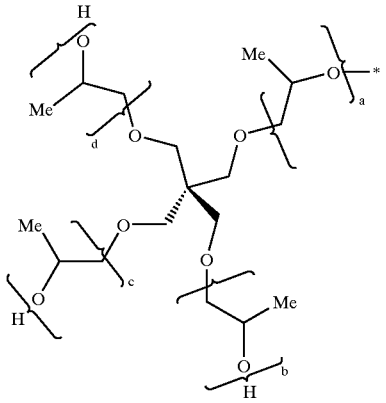
wherein a+b+c+d is from 0 to 16, preferably from 2 to 9;
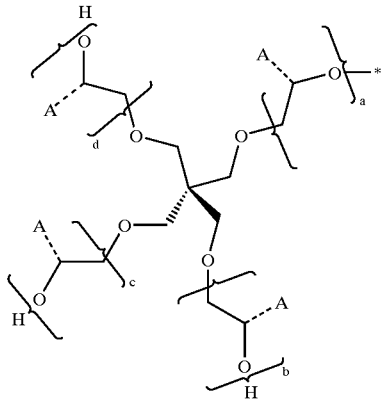
wherein A is independently selected from H and $CH_3$ and a,b,c, and d are numbers subject to an average molecular weight, $M_n$ of from 200 to 1000, preferably about 200–500, typically about 356;
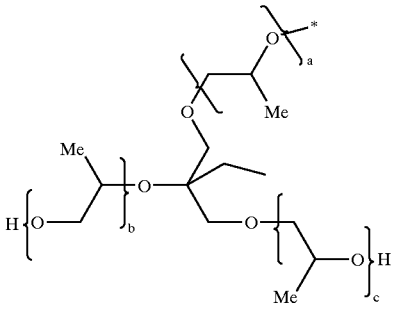
wherein a+b+c is from 0 to 16, preferably 2 to 6;
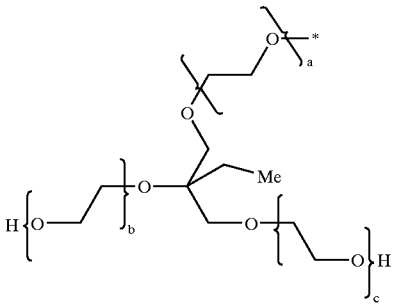

wherein a+b+c is from 0 to 16, preferably from 4 to 9;

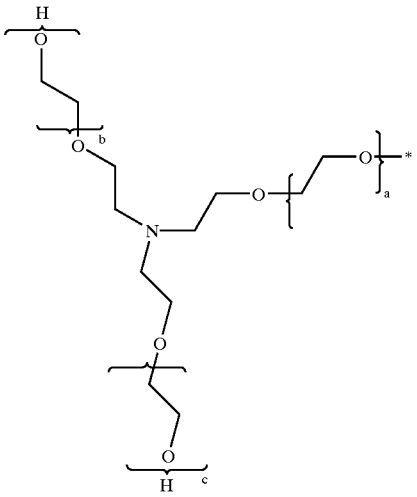

wherein a+b+c is from 1 to 16, preferably 2 to 6;

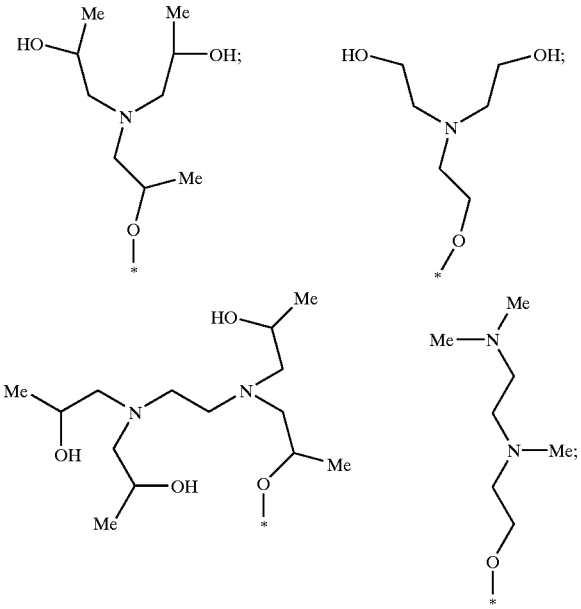

and mixtures thereof; wherein, when said ligand is nonbonded, a hydrogen atom completes the valence marked "*" in any of the above structures, and wherein, when the ligand is bonded to the photobleach compound, the valence marked "*" in any of the above structures is bonded to said metal or metalloid in an axial position.

C 2.3.1. Polyhydroxy Ligands

Preferred polyhydroxy ligands herein more generally are based on polyalkoxylated glycols or polyalkoxylated low molecular weight polyols. Such compounds include glycerol, pentaerythritol, and trimethylolpropane. Suitable alkoxylating agents include ethylene oxide, propylene oxide or butylene oxide.

Preferred polyhydroxy ligands have molecular weights below about 500 and are nonlimitingly illustrated by glycerol ethoxylates, glycerol propoxylates, glycerol ethoxylate/propoxylates, pentaerythritol ethoxylates, pentaerythritol propoxylates, pentaerythritol ethoxylate/propoxylates, trimethylolpropane ethoxylates, trimethylolpropane propoxylates, and trimethylolpropane ethoxylate/propoxylates.

C 2.3.2. Aminofunctional Ligands

Preferred aminofunctional ligands herein are nonlimitingly illustrated by alkanolamines such as triethanolamine or tripropanolamine; or poly(alkoxylates) of such lower alkanolamines, such as triethanolamine ethoxylate, triethanolamine propoxylate, or triethanolamine ethoxylate/propoxylate. Other suitable aminofunctional ligands include tetrahydroxyalkyl lower alkylene diamines, such as tetrahydroxypropyl ethylene diamine.

C 2.4. Physical Form of the Photobleach System

The photobleach system as a whole herein can in general be solid or liquid. Preferred for many purposes are photobleach systems which are multiphasic, for example comprising a first solid phase, at ambient temperatures, of the water-soluble polymer, and a second phase, which may be solid or liquid, of the photobleach. Moreover, the photobleach and the water-soluble polymer may be so well mixed that no clear phase boundary is observable by optical methods. Preferred photobleach systems fall into a number of cases:

C 2.4.1. Case of Solid Photobleach and Excess of Nonbonded Ligand

In this instance, the photobleach system can, for example, be a mixtures of non-charged hydrophobic photobleach compounds and nonbonded ligands, wherein said nonbonded ligands are selected from the group consisting of compounds capable of binding axially to a Si, Al, Ga, Ge or Sn (preferably Si(IV)) phthalocyanine moiety and said photobleach compounds are selected from the group consisting of Si, Al, Ga, Ge and Sn phthalocyanines having a bonded ligand in at least one axial position and having solid form at ambient temperature in the absence of impurities. In this case, most suitably, an excess of ligand (nonbonded ligand) is maintained while a suitable photobleach precursor is reacted with ligand to form the photobleach compound. The nonbonded ligand prevents crystallization and the mixture of photobleach compound and nonbonded ligand is combined with water-soluble polymer to form the photobleach delivery system without crystallization of the photobleach ever first having occurred.

C 2.4.2. Case of Low-melting Photobleach

In this case, the photobleach system comprises non-charged hydrophobic photobleach compounds having melting-point below about 95° C., preferably from about 35° C. to about 80° C. Suitably low melting points can be achieved by use of crystallinity disruption in the bonded ligand as taught elsewhere herein. In this instance, no nonbonded ligand is needed, and the low-melting hydrophobic photobleach can simply be mixed with the water-soluble polymer and formulated in a detergent.

C 2.4.3. Case of Solid Photobleach having Specified Crystal Size

In another case, currently viewed as less preferable than those above, the photobleach system comprises non-charged hydrophobic photobleach compounds having crystalline form and having a mean crystal size (and preferably also a maximum size) of below about 30 microns, preferably from about 0.001 to about 10 microns. This case appears particularly apposite when the axial ligands bonded to the photobleach are relatively low molecular weight, relatively symmetrical species, such as an alkanolamine.

Photobleach systems and the resulting detergent compositions can of course use any mixture of the above cases of photobleach delivery system.

C 2.5. Photobleach Hue

The essential photobleach delivery systems or photobleach compounds herein can have any visible hue. Hue preference of laundered fabrics tends to vary from one country or region to another, and can include blue, green or pink hues. The hue can be minimized using low-hue photobleach compounds as disclosed in WO 98/32832 A, WO 98/32829 A, WO 98/32828 A, WO 98/32827 A, WO 98/32826 A, WO 98/32825 A, WO 98/32824 A, WO 97/05203 A or WO 97/05202 provided that such photobleach compounds meet the requirements of hydrophobic, non-charged or nonionic character as required by the present invention.

C 2.6. Optional Components of Photobleach System—Coatings

The present detergent compositions can moreover include variants of the photobleach delivery system which comprise an external coating or other encapsulation means, in addition to the photobleach compound, the water-soluble polymer and the optional but sometimes preferable nonbonded ligand.

For example, when formulating the photobleach delivery system in an aqueous liquid detergent composition, it may be desirable to further coat or protect particles of the photobleach delivery system with a coating or hardening material such as a microcrystalline wax, or an anionic polymer or copolymer which forms complexes or coacervates with the primary water-soluble polymer of the photobleach delivery system. Such coating or protection can help ensure better integrity of the photobleach delivery system particles on storage in the liquid detergent composition. Of course, such coatings or coacervates can be used also when the photobleach delivery system is intended to be incorporated in granules, powders, pastes or tablet forms of the detergent composition.

C 2.7. Optional Components of Photobleach System—Other

Optional components of the present photobleach delivery system include cationic polymers such as cationic starches, polyethyleneimine polymers or copolymers, quaternary ammonium salts of the type used in fabric conditioners or through-the-wash softeners, or the like. Such cationic additives may further improve deposition of the photobleach delivery system on fabrics in certain detergent compositions, especially those wherein the detersive surfactant component is to a large extent nonionic rather than anionic.

Any other optional component consistent with the spirit and scope of the invention may be added to the photobleach system, provided that it does not result in a photobleach system incapable of passing the persistence and codeposition tests described hereinafter.

D. Detersive Surfactant

Detergent compositions of the invention comprise a detersive surfactant, suitably at levels of from about 0.1% to about 95%, more preferably from about 0.5% to about 50%, typically from about 1% to about 30 by weight of the detergent composition. In general, the detersive surfactant can be selected from the common commercial detersive surfactants sold for laundry detergent use, including especially anionic detersive surfactants, particularly alkylbenzene sulfonates, alkyl sulfates, methyl ester sulfonates, or mixtures thereof; and nonionic detersive surfactants, particularly alkyl alkoxylates, sugar-derived nonionic surfactants such as APG's or glucosamides, or mixtures thereof. Mixtures of anionic and nonionic detersive surfactants at ratios of from about 1:10 to about 10:1 by weight can be especially useful. Any suitable chainlength or carbon content of the hydrophobe of these surfactants can be used, for example from about $C_8$ to about $C_{20}$, more typically from about $C_8$ to about $C_{17}$. The alkylbenzene sulfonates are often used at lower carbon content, for example an average of about $C_{10}$ to $C_{12}$. When the surfactant is anionic, most commonly it is used in the sodium salt form, though other forms, for example potassium, can be used for known reasons such as to promote solubility. Any specialty surfactants, for example foam boosters, can be added if desired.

Preferred detersive surfactants for use herein include certain biodegradably branched surfactants, described in more detail hereinafter, and certain selected cationic surfactants. The selected cationic surfactants are especially useful in combination with linear or branched alkylbenzene sulfonates.

Biodegradably Branched Surfactants

The present invention includes important embodiments comprising at least one biodegradably branched and/or crystallinity disrupted and/or mid-chain branched surfactant or surfactant mixture. The terms "biodegradably branched" and/or "crystallinity disrupted" and/or "mid-chain branched" (acronym "MCB" used hereinafter) indicate that such surfactants or surfactant mixtures are characterized by the presence of surfactant molecules having a moderately non-linear hydrophobe; more particularly, wherein the surfactant hydrophobe is not completely linear, on one hand, nor is it branched to an extent that would result in unacceptable biodegradation. The preferred biodegradably branched surfactants are distinct from the known commercial LAS, ABS, EXXAL®. LIAL®, etc. types, whether branched or unbranched (though these types can also, ehile less preferably, be used as the detersive surfactant herein) The biodegradably branched detersive surfactants comprise particularly positioned light branching, for example from about one to about three methyl, and/or ethyl, and/or propyl or and/or butyl branches in the hydrophobe or "tail" wherein the branching is located remotely from the surfactant headgroup, preferably toward the middle of the hydrophobe. Typically from one to three such branches can be present on a single hydrophobe, preferably only one. Such biodegradably branched surfactants can have exclusively linear aliphatic hydrophobes, or the hydrophobes can include cycloaliphatic or aromatic substitution. Highly preferred are MCB analogs of common linear alkyl sulfate, linear alkyl poly(alkoxylate) and linear alkylbenzenesulfonate surfactants. said surfactant suitably being selected from mid-chain-$C_1$–$C_4$-branched $C_8$–$C_{18}$-alkyl sulfates, mid-chain-$C_1$–$C_4$-branched $C_8$–$C_{18}$-alkyl ethoxylated, propoxylated or butoxylated alcohols, mid-chain-$C_1$–$C_4$-branched $C_8$–$C_{18}$- alkyl ethoxysulfates, mid-chain-$C_1$–$C_4$-branched $C_8$–$C_{16}$-alkyl benzenesulfonates and mixtures thereof. When anionic, the biodegradably branched, or other detersive surfactants herein can in general be in acid or salt, for example sodium, potassium, ammonium or substituted ammonium, form. The biodegradably branched surfactants offer substantial improvements in cleaning performance and/or usefulness in cold water and/or resistance to water hardness and/or economy of utilization. Such surfactants can, in general, belong to any known class of detersive surfactants, e.g., anionic, nonionic, cationic, or zwitterionic. All of these types, whether biodegradably banched or not, can be used in the present invention. The preferred biodegradably branched surfactants are synthesized through processes of Procter & Gamble, Shell, and Sasol. These surfactants are more fully disclosed in WO98/23712 A published Jun. 4, 1998; WO97/38957 A published Oct. 23, 1997; WO97/38956 A published Oct. 23, 1997; WO97/39091 A published Oct. 23, 1997; WO97/39089 A published Oct. 23, 1997; WO97/39088 A published Oct. 23, 1997; WO97/39087 A1 published Oct. 23, 1997; WO97/38972 A published Oct. 23, 1997; WO 98/23566 A Shell, published Jun. 4, 1998; technical bulletins of Sasol; and other pending patent applications assigned to Procter & Gamble.

Preferred biodegradably branched surfactants herein in more detail include those of WO98/23712 A which includes disclosure of MCB nonionic surfactants including MCB primary alkyl polyoxyalkylenes of formula (1):

$CH_3CH_2(CH_2)_wC(R)H(CH_2)_xC(R^1)H(CH_2)_yC(R^2)H(CH_2)_z(EO/PO)_mOH$ (1), where the total number of carbon atoms in the branched primary alkyl moiety of this formula, including the R, $R^1$ and $R^2$ branching, but not including the carbon atoms in the EO/PO alkoxy moiety, is preferably 14–20, and wherein further for this surfactant mixture, the average total number of carbon atoms in the MCB primary alkyl hydrophobe moiety is preferably 14.5–17.5, more preferably 15–17; R, $R^1$ and $R^2$ are each independently selected from hydrogen and 1–3C alkyl, preferably methyl, provided R, $R^1$ and $R^2$ are not all hydrogen and, when z is 1, at least R or $R_1$ is not hydrogen; w is an integer of 0–13; x is an integer of 0–13; y is an integer of 0–13; z is an integer of at least 1; w+x+y+z is 8–14; an EO/PO are alkoxy moieties preferably selected from ethoxy, propoxy and mixed ethoxy/propoxy groups, where m is at least 1, preferably 3–30, more preferably 5–20, most preferably 5–15. Such MCB nonionics can alternately include butylene oxide derived moieties, and the —OH moiety can be replaced by any of the well-known end-capping moieties used for conventional nonionic surfactants. Other analogous MCB surfactants include MCB alkyl carboxylate surfactants, MCB acyl taurate, MCB acyl isethionate, MCB acyl sarcosinate or MCB acyl N-methylglucamide surfactants. Especially preferred anionic types of MCB surfactant include, see for example WO97/39088, surfactant compositions comprising 0.001–100% of MCB primary alkyl sulphate(s) of formula (I): $CH_3CH_2(CH)_wCHR(CH_2)_xCHR^1(CH_2)_yCHR^2(CH_2)_zOSO_3M$ (I) wherein the total number of C atoms in compound (I) including R, $R^1$ and $R^2$, is preferably 14–20 and the total number of C atoms in the branched alkyl moieties preferably averages 14.5–17.5 (especially 15–17); R, $R^1$ and $R^2$ are selected from H and 1–3C alkyl (especially Me) provided R, $R^1$ and $R^2$ are not all H; when z=1 at least R or $R^1$ is not H; M are cations especially selected from Na, K, Ca, Mg, quaternary alkyl ammonium of formula $N^+R^3R^4R^5R^6$ (II); M is especially Na and/or K; $R^3$, $R^4$, $R^5$, $R^6$ are selected from H, alkylene, 4–22C branched alkylene, 1–6C alkanol, 1–22C alkenylene, and/or 4–22C branched alkenylene; w, x, y=0–13; z is at least 1; w+x+y+z=8–14.

WO 98/23566 A Shell, published Jun. 4, 1998 discloses branched primary alcohol compositions having 8–36 C atoms and an average number of branches per mol of 0.7–3 and comprising ethyl and methyl branches. Also disclosed are: (1) a branched primary alkoxylate composition preparable by reacting a branched primary alcohol composition as above with an oxirane compound; (2) a branched primary alcohol sulphate preparable by sulphating a primary alcohol composition as above; (3) a branched alkoxylated primary alcohol sulphate preparable by alkoxylating and sulphating a branched alcohol composition as above; (4) a branched primary alcohol carboxylate preparable by oxidizing a branched primary alcohol composition as above; and (5) detergent compositions. These primary alcohol sulphates, alkoxylates, alkoxy sulphates and carboxylates are biodegradably branched or mid-chain branched detersive surfactants for the purposes of the present invention. They exhibit good cold water detergency and biodegradability.

Biodegradably branched surfactants useful herein also include the modified alkylaromatic, especially modified alkylbenzenesulfonate surfactants, described in copending commonly assigned patent applications P&G Case 7303, 7304, 6766. These include alkylarylsulfonate surfactant systems comprising from about 10% to about 100% by weight of said surfactant system of two or more crystallinity-disrupted alkylarylsulfonate surfactants of formula $(B—Ar—D)_a(M^{q+})_b$ wherein D is $SO_3$–, M is a cation or cation mixture, q is the valence of said cation, a and b are numbers selected such that said composition is electroneutral; Ar is selected from benzene, toluene, and combinations thereof; and B comprises the sum of at least one primary hydrocarbyl moiety containing from 5 to 20 carbon atoms and one or more crystallinity-disrupting moieties wherein said crystallinity-disrupting moieties interrupt or branch from said hydrocarbyl moiety. Such compositions also include surfactant mixtures comprising (a) from about 60% to about 95% by weight of a mixture of branched alkylbenzenesulfonates having formula (I):

(I)

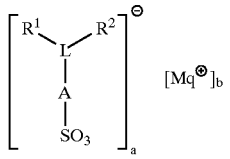

wherein L is an acyclic aliphatic moiety consisting of carbon and hydrogen and having two methyl termini, and wherein said mixture of branched alkylbenzenesulfonates contains two or more of said compounds differing in molecular weight of the anion of said formula (I) and wherein said mixture of branched alkylbenzenesulfonates is characterized by an average carbon content of from about 10.0 to about 14.0 carbon atoms, wherein said average carbon content is based on the sum of carbon atoms in $R^1$, L and $R^2$, and further, wherein L has no substituents other than A, $R^1$ and $R^2$; M is a cation or cation mixture (preferably selected from H, Na) having a valence q (typically from 1 to 2, preferably 1); a and b are integers selected such that said compounds are electroneutral (a is typically from 1 to 2, preferably 1, b is 1); $R^1$ is $C_1$–$C_3$ alkyl (preferably $C_1$–$C_2$ alkyl, more preferably methyl); $R^2$ is selected from H and $C_1$–$C_3$ alkyl; A is a benzene moiety; and (b) from about 5% to about 60% by weight of a mixture of nonbranched alkylbenzenesulfonates having formula (II):

(II)

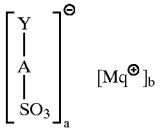

wherein a, b, M, A and q are as defined hereinbefore and Y is an unsubstituted linear aliphatic moiety consisting of carbon and hydrogen having two methyl termini, and wherein Y has an average carbon content of from about 10.0 to about 14.0; and wherein said composition is further characterized by a 2/3-phenyl index of from about 350 to about 10,000. Also encompassed by way of "mid-chain branched" or "biodegradably branched" surfactants of the alkylbenzene-derived types are surfactant mixtures comprising the product of a process comprising the steps of: alkylating benzene with an alkylating mixture; sulfonating the product of (1); and neutralizing the product of (II); wherein said alkylating mixture comprises: (a) from about 1% to about 99.9%, by weight of branched $C_7$–$C_{20}$ monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_7$–$C_{20}$ linear aliphatic olefins; wherein said alkylating mixture contains said branched $C_7$–$C_{20}$ monoolefins having at least two different carbon numbers in said $C_7$–$C_{20}$ range, and has a mean carbon content of from about 9.5 to about 14.5 carbon atoms; and wherein said components (a) and (b) are at a weight ratio of at least about 15:85.

Selected Cationic Surfactants

Preferred detergent compositions also include those wherein the photobleach system is combined with selected cationic detersive surfactants, especially when alkylbenzene sulfonate detersive surfactants are also present. These selected cationic surfactants include: (i) cationic surfactants having one long chain and three relatively short chains in which one or more substituents attached to the nitrogen atom contain oxygen, as for example in hydroxyethyl, and/or in which the relatively long chain is branched. Such surfactants include, for example, compounds having the formula $R^1N^+R^2R^3R^4X^-$ wherein $R^1$ is $C_8$–$C^{16}$ linear or branched alkyl (optionally including one or more aryl, ether or ester moieties) and wherein $R^2$–$R^4$ can vary independently and can, for example, comprise methyl, ethyl, propyl, butyl, hydroxyethyl, hydroxypropyl and mixtures thereof provided that at least one of $R^2$–$R^4$ is hydroxyalkyl, preferably hydroxyethyl. $X^-$ is any compatible anion, for example one selected from halogen, (e.g. chloride, bromide), acetate, citrate, lactate, glycolate, phosphate nitrate, sulfate, and alkylsulfate. Mixtures of these compounds and the corresponding anions can be used; and/or (ii) cationic surfactants having the formula: $[R^2(OR^3)_y][R^4(OR^3)_y]_2R^5N^+X^-$ wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion, for example chloride and/or cationic surfactants other than the conventional alkyltrimethylammonium salts corresponding to the general formula:

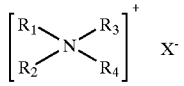

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals; wherein said compounds the aliphatic groups contain, in addition to carbon and hydrogen atoms, other linkages such as ether linkages, and/or other groups such as amino groups. The longer chain aliphatic groups, e.g., those of about 12 carbons, or higher, can be saturated or unsaturated. Preferred is when $R_1$, $R_2$, $R_3$, and $R_4$ are independently selected from C1 to about C22 alkyl. Especially preferred for some purposes are cationic materials containing two long alkyl chains and two short alkyl chains or those containing one long alkyl chain and three short alkyl chains other than methyl. The long alkyl chains in the compounds described in the previous sentence have from about 8 to about 22 carbon atoms, preferably from about 10 to about 14 carbon atoms.

Also useful herein are the bis-alkoxylated quaternary ammonium (bis-AQA) surfactants and combinations including same disclosed in WO9744433 A1 WO9744431 A1, WO9744432 A1, WO9743394 A, WO9743393 A, WO9743391 A, WO9743390 A, WO9743389 A, WO9743371 A, WO9744420 A, WO9744419 A, WO9744418 A, WO9743388 A, WO9743387 A, WO9743365 A, WO9743364 A. See also WO9738968 A1.

The selected cationic surfactants can be used herein for one or more purposes, including net contribution to cleaning, especially of greasy soils, or for other purposes, such as softening through the wash and/or for antimicrobial purposes.

Suitable levels of these cationic surfactants herein are from about 0.1% to about 20%, preferably from about 1% to about 15%, although much higher levels, e.g., up to about 30% or more, may be useful especially in nonionic: cationic (i.e., limited or anionic-free) formulations. Highly preferred compositions however combine the photobleach.system, the above-defined cationic detersive surfactant at a very low level, e.g., from about 0.1% to about 5%, preferably not more than about 2%, and an anionic detersive surfactant or an anionic/nonionic surfactant mixture comprising the balance of the detersive surfactant component of the detergent composition. The selected cationic surfactants, even at said low levels, are surprisingly effective with the photobleach system without spoiling its effectiveness.

Conventional, especially alkyltrimethylammonium cationic surfactants can be used in conjunction with the selected cationic surfactant types if desired.

Selected Sugar-derived Surfactants

Preferred detergent compositions herein also include those wherein the photobleach system is combined with selected sugar-derived detersive surfactants. These include in particular the $C_1$–$C_{18}$ alkyl N-methyl glucamides, for example as disclosed in WO 92/06070 A or WO 92/05071 A published Apr. 16, 1992; any of the known lactobionamide surfactants, and combinations of the glucosamides and/or lactobionamides with alkylpolyglucosides (APG's).

Cationic-Anionic Ion Pair Surfactants

U.S. Pat. No. 5,472,455 discloses water-soluble complexes of anionic and cationic surfactants. These are useful in conjunction with photobleach systems.

Accordingly, preferred detergent compositions herein are those wherein the detersive surfactant comprises a member selected from the group consisting of: (i) anionic, cationic, nonionic or zwitterionic detersive surfactants, especially including at least one detersive surfactant having a biodegradably branched, preferably $C_1$–$C_4$ alkyl mid-chain branched, hydrophobe; (b) (ii) cationic cosurfactants other than cationic surfactants in (b) (i); (b) (iii) mixtures of (b)(i) and (b)(ii); and (b) (iv) mixtures of (b)(i) and/or (b)(ii) with conventional detersive surfactants other than (b)(i) or (b)(ii).

E. Non-Surfactant Detergent Adjunct

Detergent compositions herein additionally comprise at least one nonsurfactant detergent adjunct. Preferably said nonsurfactant detergent adjunct, (c), comprises one or more members selected from the group consisting of: (c) (i) bleaching enzymes; (c) (ii) non-bleaching enzymes; (c) (iii) transition metal bleach catalysts; (c) (iv) organic bleach boosters; (c) (v) bleach activators; (c) (vi) oxygen bleach sources; (c) (vii) preformed peracids; (c) (viii) soil release agents; (c) (ix) builders; (c) (x) chelants; (c) (xi) conventional water-soluble sulfonated photobleaches; and (c) (xii) mixtures of any of (c)(i)–(c)(xi).

F. Levels and Proportions

The weight ratio of the water-soluble polymer to the photo-bleaching component in the photo-bleaching agent is from 1000:1 to 1:10, more preferably from 1000:1 to 4:1, more preferably still from 100:1 to 20:1, most preferably from 60:1 to 20:1

G. Form of the Detergent Composition

The detergent compositions of the invention can have any suitable form, for example granules, tablets, pouches, syndet bars, gels, pastes or the like. Other suitable forms include heavy-duty liquid laundry detergents, substantially nonaqueous laundry detergents in liquid or solid form, and aqueous forms of any of said detergents wherein the water-soluble polymer has a solubility parameter as defined hereinabove which is in the general range from about 15 $MPa^{1/12}$ to about 42 $MPa^{1/2}$.

H. Process for Preparing Intermediate Compositions—Photobleach Systems

The present invention further encompasses a process for providing photobleach systems, more particularly, intermediate compositions of formulated photobleaches for use in detergents, or processes for improving ease of formation thereof, said process comprising the steps of: (a) providing a photobleach precursor having at least one axial site available for substitution by a ligand; (b) a stage of forming a hydrophobic non-salt liquid phase of photobleach as characterized in the absence of solvents and other additives at one or more temperatures in the range from about −40° C. to about 120° C.; wherein said stage of forming comprises at least one step selected from: (i) axially substituting said photobleach precursor with one or more ligands having crystallinity-disrupting or symmetry-lowering moieties and (c) mixing said non-salt liquid phase with a polymer, thereby forming an intimate mixture of said photobleach in said polymer.

In a preferred process of this type, said temperature is in the range from about −10° C. to about 50° C. and said photobleach is selected from the group consisting of non-sulfonated metal- or metalloid-containing photobleach compounds; and said polymer is selected from the group consisting of at least partially water-soluble polymers, preferably the water-soluble polymers defined and illustrated herein.

In a variation of the inventive process directed at forming detergent compositions, there is also encompassed a process wherein stage (b) is conducted without organic solvents, preferably without water, alcohols, glycerol and in the absence of detersive surfactants, and step (c) is followed by a step, (d) of mixing said dispersion with at least one detersive surfactant and at least one non-surfactant detergent adjunct, thereby forming a laundry detergent composition.

Another suitable process of the invention is a process for producing a detergent composition having improved delivery of a photobleach to a fabric to be laundered, said process comprising the steps of: (a) providing a photobleach selected from the group consisting of non-salt photobleaches having hydrophobic character; (b) providing a polymer selected from the group consisting of at least partially water-soluble synthetic polymers; (c) mixing said photobleach and said polymer in any order to form a premix of said photobleach in said polymer; (d) mixing the premix of said photobleach and said polymer with at least one detersive surfactant and at least one detergent adjunct other than detersive surfactant, thereby forming a detergent composition; provided that said premix is characterized by at least partial copresence of said polymer with said photobleach under laundry persistence test conditions including the presence of a test surfactant. Suitable as the "test surfactant" are detersive surfactants similar or identical to those which will be used in an actual consumer detergent product. Suitable "test surfactant" for example includes commercial linear alkylbenzene sulfonates, sodium salt form; or biodegradably dranched surfactants as disclosed elesewhere herein.

In a preferred process, said photobleach is a non-charged phthalocyanine compound of Silicon or Aluminum having one or more ligands bonded axially.

In another preferred process, said premix of said photobleach in said polymer provides a photobleach deposition level on a test fabric of no more than about 5 ppm by weight on said fabric.

In yet another preferred process variation, said mixing step, (c), is conducted without reliance on milling, high energy mixing, or organic solvents.

In many of the preferred processes, said ligands are polyhydroxy ligands, whereby said ligands promote compatible mixing of said photobleach with said polymer.

In another process variation, after forming said premix in said step (c) and before incorporating said premix into said detergent composition in said step (d), said premix is coated or encapsulated.

The present invention also encompasses the products of any of said processes and their modifications, such as the coated or encapsulated photobleach/polymer premix wherein the composition is coated or encapsulated with a coating or encapsulating agent other than said polymer.

Also encompassed are detergent compositions comprising the product of any of the foregoing processes and wherein the level of photobleach in said detergent composition is no more than about 10,000 ppm, e.g., from about 0.015 ppm to about 0.5%, more preferably from about 0.010% to about 0.050%, more preferably still from about 0.001% to about 0.01% of hydrophobic photobleach compound.

I. Methods of Use

The present invention also encompasses methods of use of the photobleach delivery systems and methods of use of the detergent compositions.

One such method is a method of cleaning a dingy fabric comprising a step of treating the dingy fabric with a detergent composition comprising a hydrophobic nonionic photobleach and a detersive surfactant; provided that said hydrophobic nonionic photobleach is formulated as a premix in a water-soluble polymer, preferably PEG or PVP, and said premix passes the laundry persistence test and preferably also the laundry deposition test as defined elsewhere herein.

In a variation, the invention encompasses a method as described supra further provided that said detergent composition comprises an additional (can be photobleach-free) aliquot of PEG, PVP or another water-soluble polymer as a processing aid, fabric softener, dispersant, or soil release agent.

J. Advantages

The present invention has numerous advantages. For example, it can be used to deliver the hydrophobic photobleaches to soiled fabrics effectively, rather than having large proportions of photobleach wasted by loss in the wash water. Thus, the technical problem presented is solved. The invention provides improved photobleaching of dingy soils. It economizes on the amounts of expensive photobleach materials needed. The invention is operable with important recently developed classes of mid-chain branched surfactants which clean very well and tend to limit hydrophobic photobleach deposition when the photobleach is not incorporated into the inventive photobleach delivery system The invention accommodates a range of hydrophobic photobleaches, providing flexibility to the formulator, so that superoxide generating types of hydrophobic photobleach, or other types, such as low-hue types, can be delivered. The invention works well in detergent compositions designed both for economic use in the developed countries, as well as in detergent compositions useful in developing countries. The water-soluble polymers used, such as the PEG type, are inexpensive, safe and nontoxic. In short, the invention is environmentally attractive and a significant technical advance.

K. Other Embodiments

While the term "photobleach" has been used for the materials and compositions herein, the present invention encompasses all other benefits or "second uses" of the disclosed compositions, regardless of the terminology. Thus, the materials used could equally have been referred to as "photodisinfectants" or "photoactive agents". Specifically, the present compositions provide photodisinfectancy, antibacterial activity, hueing, and not just photobleaching benefits. All such benefits accruing inherently as a result of use of the disclosed compositions, are part of the present invention.

The present invention has numerous other embodiments and/or ramifications including, but not limited to:

A detergent composition in accordance with the invention in either its composition embodiments or defined as the product of the above-described processes comprising, as one of the essential detersive surfactants, from about 0.01% to about 30% of a member selected from the group consisting of conventional alkoxylated nonionic detersive surfactants; detersive surfactants having a biodegradably branched, preferably $C_1$–$C_4$ alkyl mid-chain branched, hydrophobe; and mixtures thereof.

Also encompassed is a detergent composition wherein said photobleach and said water-soluble polymer have a low exotherm, no exotherm, or mix endothermically.

Also encompassed is a detergent composition which is substantially free from organic chemicals selected from the group consisting of perfumes containing alcohol and aldehyde compounds, N-lower alkyl neoalkanol amides, triclosan, proteins and benzyl benzoate.

Also included is a detergent composition wherein said polymer is substantially free from pyridine moieties and said photobleach is substantially free from porphyrins or naphthalocyanines.

Perfumed as well as non-perfumed detergent compositions are included.

Also included herein are detergent compositions additionally comprising a member selected from the group consisting of perfumes, pro-perfumes, antimicrobials, antioxidants, enzyme inhibitors, insect repellents, sunscreens or dyed fabric anti-fading agents, and mixtures thereof.

L. EXAMPLES

Photobleach Synthesis Characterization and Testing Examples (I-1–I-18)

Example I-1

Synthesis of Silicon Phthalocyanine bis(1 PO/OH Glycerol Propoxylate)

Structure E-1

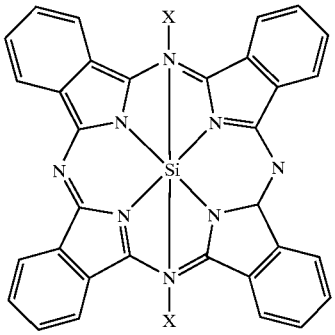

wherein bonded ligands, X, occupy axial positions and wherein these bonded ligands are derived by deprotonating the ligand:

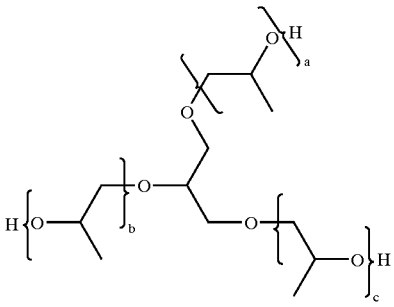

a + b + c ≈ 3

To a 500 mL round bottom flask is added the ligand PO/OH glycerol propoxylate ($M_n$ 266, 36 g, 0.135 moles, Aldrich [25791-96-2]), followed by xylenes (170 mL). The mixture is heated to 170° C. and is refluxed for 4 hours while water is removed by azeotropic distillation. The flask is then charged with the photobleach precursor silicon phthalocyanine dihydroxide (0.711 g, $1.24\times10^{-3}$ moles, Aldrich) and the mixture is heated again for 3.5 hours. The xylenes are evaporated off under reduced pressure and methylene chloride is added (200 mL). The methylene chloride is extracted three times with 10 wt. % aqueous sodium chloride (200 mL). The methylene chloride is evaporated under reduced pressure to give 6.8 g of the photobleach compound Silicon Phthalocyanine bis(1 PO/OH glycerol propoxylate as a blue liquid. This compound is a crystalline solid when pure. The liquid form contains excess (nonbonded) ligand. UV-Vis (dimethylformamide) $\lambda_{max}$=670, $\epsilon$=217,200.

Example I-2

Synthesis of Silicon Phthalocyanine bis(3/4 EO/OH Pentaerythritol Ethoxylate)

This photobleach has the general structure shown in Structure E-1 of Example I-1 supra. However, bonded ligands, X, which occupy axial positions are derived by deprotonating the ligand:

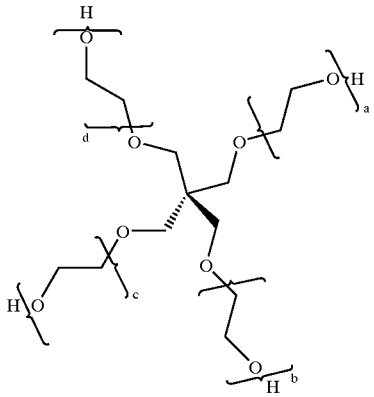

wherein a+b+c+d is about 3.

To a 500 mL round bottom flask is added the ligand 3/4 EO/OH Pentaerythritol Ethoxylate ($M_n$ 270, 24 g, Aldrich [30599-15-6]), followed by xylenes, (170 mL), and the mixture is heated to 170° C. and refluxed for 4 hours while water is removed by azeotropic distillation. The flask is then charged with the photobleach precursor silicon phthalocyanine dihydroxide (0.50 g, 8.7×10–4 moles, Aldrich) and the mixture is heated again for 4.0 hours. The xylenes are evaporated off under reduced pressure and the blue oil is diluted with water (250 mL). Sodium sulfate (5.0 g) is added and the solution is transferred to a separatory funnel. The solution is extracted 3 times with methylene chloride (200 mL each time). The methylene chloride is evaporated under reduced pressure to give 1.2 g of the photobleach compound Silicon Phthalocyanine bis(3/4 EO/OH Pentaerytritol Ethoxylate) as a blue oil. This compound is a crystalline solid when pure, and the liquid (oil) form contains excess (nonbonded) ligand.

Example I-3

Synthesis of Silicon Phthalocyanine bis(15/4 EO/OH Pentaerythritol Ethoxylate)

This photobleach has the general structure shown in Structure E-1 of Example I-1 supra. However, bonded ligands, X, which occupy axial positions are derived by deprotonating the ligand:

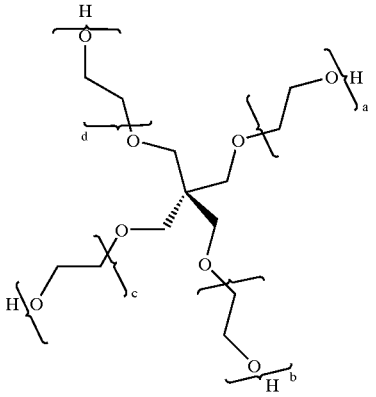

wherein a+b+c+d is about 15.

To a 500 mL round bottom flask is added 24 g of the ligand 15/4 EO/OH pentaerythritol Ethoxylate (Mn 797), an Aldrich product [30599-15-6], followed by xylenes, 170 mL, and the mixture is heated to 170° C. to a reflux for 4 hours while water is removed by azeotropic distillation. The flask is then charged with the photobleach precursor silicon phthalocyanine dihydroxide 0.50 g (8.7×10−4 moles) and the mixture is heated again for 4.0 hours. The xylenes are evaporated off under reduced pressure and the blue oil is diluted with water 250 mL. Sodium sulfate 5.0 g is added and the solution is transferred to a separatory funnel. The solution is extracted 3 times with methylene chloride (200 mL). The methylene chloride is evaporated under reduced pressure to give the photobleach compound Silicon Phthalocyanine bis(15/4 EO/OH Pentaerythritol Ethoxylate) as a blue oil. This photobleach compound is a crystalline solid when pure, and the liquid (oil) form contains excess (nonbonded) ligand.

Example I-4

Synthesis of Silicon Phthalocyanine bis(15/4 PO/OH Pentaerythritol Propoxylate)

This photobleach has the general structure shown in Structure E-1 of Example I-1 supra. However, bonded ligands, X, which occupy axial positions are derived by deprotonating the ligand:

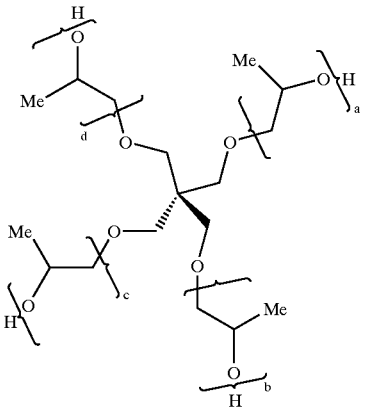

wherein a+b+c+d is about 5.

To a 500 mL round bottom flask is added the ligand 5/4 PO/OH Pentaerythritol propoxylate (Mn 426) 30 g, an Aldrich product [9051-49-4], followed by xylenes 170 mL and the mixture is heated to 170° C. to a reflux for 4 hours while water is removed by azeotropic distillation. The flask is then charged with the photobleach precursor silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give the photobleach compound Silicon Phthalocyanine bis(5/4 PO/OH Pentaerythritol propoxylate) as a blue liquid. This photobleach compound is a crystalline solid when pure, and the liquid (oil) form contains excess (nonbonded) ligand. UV-Vis (dimethylformamide) $\lambda_{max}$=670, $\epsilon$=209,500.

Example I-5

Synthesis of Silicon Phthalocyanine bis(17/8 PO/OH Pentaerythritol Propoxylate)

This photobleach has the general structure shown in Structure E-1 of Example I-1 supra. However, bonded ligands, X, which occupy axial positions are derived by deprotonating the ligand:

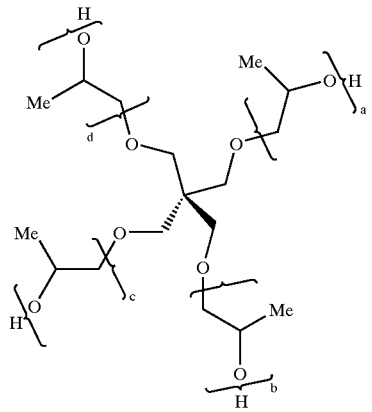

wherein a+b+c+d is about 8.5.

To a 500 mL round bottom flask is added the ligand 17/8 PO/OH Pentaerythritol propoxylate (Mn 629) 30 g, an Aldrich product [9051-49-4], followed by xylenes 170 mL and the mixture is heated to 170° C. to a reflux for 4 hours while water is removed by azeotropic distillation. The flask is then charged with the photobleach precursor silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give Silicon Phthalocyanine bis(17/8 PO/OH Pentaerythritol propoxylate) as a blue liquid. This photobleach compound is a crystalline solid when pure, and the liquid (oil) form contains excess (nonbonded) ligand.

Example I-6

Synthesis of Silicon Phthalocyanine bis (Pentaerythritol Propoxylate/Ethoxylate)

This photobleach has the general structure shown in Structure E-1 of Example I-1 supra. However, bonded ligands, X, which occupy axial positions are derived by deprotonating the ligand:

wherein each A can very independently and is selected from the group consisting of H and $CH_3$; and a,b,c and d are numbers provided that the number average molecular weight, $M_n$ is from about 201 to about 1001, preferably about 201–501, in the present example, about 356.

To a 500 mL round bottom flask is added the ligand Pentaerythritol propoxylate/ethoxylate (Mn 356) 30 g, an Aldrich product [30374-35-7], followed by xylenes 170 mL and the mixture was heated to 170° C. to a reflux for 4 hours while water is removed by azeotropic distillation. The flask is then charged with silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give the photobleach compound Silicon Phthalocyanine bis(Pentaerythritol propoxylate/ethoxylate) as a blue liquid. This photobleach compound is a crystalline solid when pure, and the liquid (oil) form contains excess (nonbonded) ligand.

Example I-7

Synthesis of Silicon Phthalocyanine bis(1 PO/OH Trimethylolpropane Propoxylate)

This photobleach has the general structure shown in Structure E-1 of Example I-1 supra. However, bonded ligands, X, which occupy axial positions are derived by deprotonating the ligand:

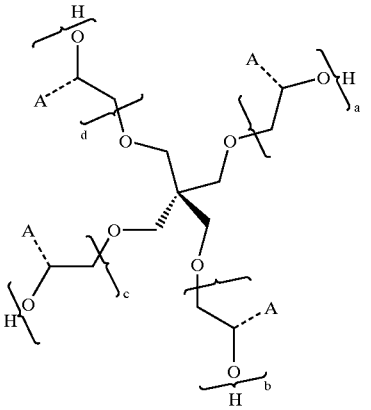

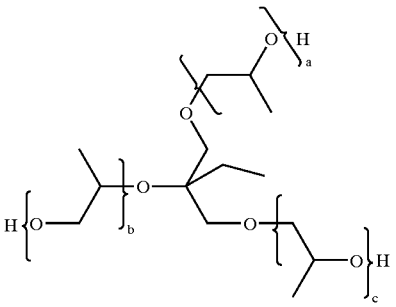

wherein a+b+c is about 3.

To a 500 mL round bottom flask is added the ligand 1 PO/OH Trimethylolpropane propoxylate ($M_n$ 308, 30 g, Aldrich [25723-16-4]), followed by xylenes 170 mL and the mixture is heated to 170° C. to a reflux for 4 hours while water is removed by azeotropic distillation. The flask is then charged with the photobleach precursor silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give the photobleach compound Silicon Phthalocyanine bis(1PO/OH Trimethylolpropane propoxylate) as a blue liquid. This photobleach compound is a crystalline solid when pure, and the liquid (oil) form contains excess (nonbonded) ligand.

Example I-8

Synthesis of Silicon Phthalocyanine bis(2.5EO/OH Trimethylolpropane Ethoxylate)

This photobleach has the general structure shown in Structure E-1 of Example I-1 supra. However, bonded ligands, X, which occupy axial positions are derived by deprotonating the ligand:

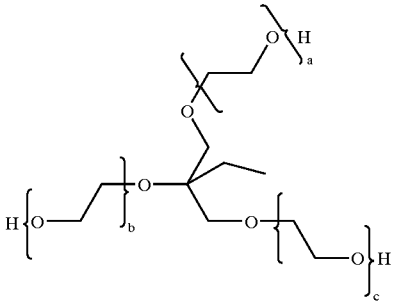

wherein a+b+c is about 7.5.

To a 500 mL round bottom flask is added the ligand 2.5EO/OH Trimethylolpropane ethoxylate (Mn 450) 30 g, an Aldrich product [50586-59-9], followed by xylenes 170 mL and the mixture is heated to 170° C. to a reflux for 4 hours while water is removed by azeotropic distillation. The flask is then charged with the photobleach precursor silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give the photobleach compound Silicon Phthalocyanine bis (2.5EO/OH Trimethylolpropane ethoxylate) as a blue liquid. This photobleach compound is a crystalline solid when pure, and the liquid (oil) form contains excess (nonbonded) ligand.

Example I-9

Synthesis of Silicon Phthalocyanine bis(1 EO/OH Triethanolamine Ethoxylate)

This photobleach has the general structure shown in Structure E-1 of Example I-1 supra. However, bonded ligands, X, which occupy axial positions are derived by deprotonating the ligand:

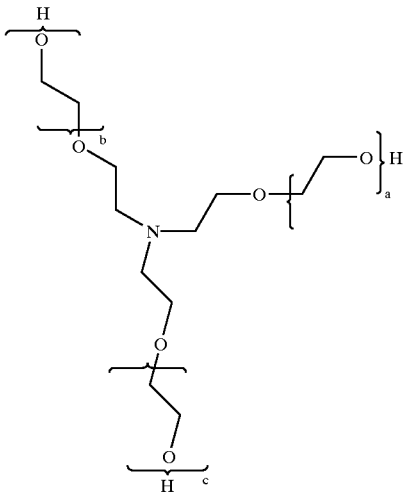

wherein a+b+c is about 3.

To a 500 mL round bottom flask is added the ligand 1 EO/OH Triethanolamine ethoxylate ($M_n$ 280, 30 g, Aldrich [36936-60-4]), followed by xylenes (170 mL) and the mixture is heated to 170° C. to a reflux for 4 hours while water is removed by azeotropic distillation. The flask is then charged with the photobleach precursor silicon phthalocyanine dihydroxide 0.5 g (8.7×10−4 moles) and the mixture is heated again for 3.5 hours. The xylenes are evaporated off under reduced pressure and methylene chloride is added 200 mL. The methylene chloride is extracted three times with 10% sodium chloride 200 mL. The methylene chloride is evaporated under reduced pressure to give the photobleach compound Silicon Phthalocyanine bis(1 EO/OH Triethanolamine ethoxylate) as a blue liquid. This photobleach compound is a crystalline solid when pure, and the liquid (oil) form contains excess (nonbonded) ligand.

Example I-10

Preparation of Silicon Phthalocyanine-di-(2-((2-(Dimethylamino)ethyl)-methylamino)ethanol)

This photobleach has the general structure shown in Structure E-1 of Example I-1 supra. However, bonded ligands, X, which occupy axial positions, are derived from 2-((2-(Dimethylamino)ethyl)-methylamino)ethanol and have the structure:

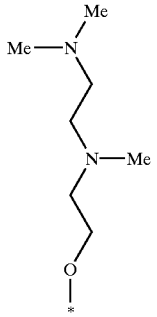

wherein the asterisk (*) shows the point of bonding to Si(PC). A mixture of the photobleach precursor silicon phthalocyanine dihydroxide (0.25 g, 0.44 mmole), the ligand 2-((2-(Dimethylamino)ethyl)-methylamino)ethanol (9.8 g, 67 mmole, Aldrich) and xylenes (175 mL) is heated to reflux over 1.5 hr. The solution is continued at reflux for 2 hr. while water is removed by azeotropic distillation. The reaction mixture is then cooled and the solvent removed in vacuo. The resulting crude oil is dissolved in dimethylformamide (50 mL) and is added to water (800 mL) over about 0.5 hr. A blue solid forms. This is collected by filtration, and dried under vacuum at 80° C. This is the photobleach compound silicon phthalocyanine-di-(2-((2-(Dimethylamino)ethyl)-methylamino)ethanol), in solid microcrystalline form, without significant amounts of excess (nonbonded) ligand. The crystal size distribution is estimated as 100% <30 micron, mean size <10 micron.

Example I-11

Preparation of Silicon Phthalocyanine-di-(triisopropanolamine)

This photobleach has the general structure shown in Structure E-1 of Example I-1 supra. However, bonded ligands, X, which occupy axial positions, are derived from triisopropanolamine and have the structure:

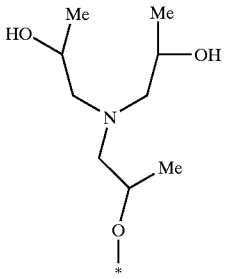

wherein the asterisk (*) shows the point of bonding to Si(PC). A mixture of the photobleach precursor silicon phthalocyanine dihydroxide (0.25 g, 0.44 mmole), the ligand triisopropanolamine (12.8 g, 67 mmole, Aldrich) and xylenes (175 mL) is heated to reflux over 1.5 hr. The solution is continued at reflux for 2 hr. while water is removed by azeotropic distillation. The reaction mixture is then cooled and the solvent removed in vacuo. The resulting crude oil is dissolved in dimethylformamide (50 mL) and is added to water (800 mL) over about 0.5 hr. A blue solid forms. This is collected by filtration, and dried under vacuum at 80° C. This is the photobleach compound silicon phthalocyanine-di-(triisopropanolamine), in solid microcrystalline form, without significant amounts of excess (nonbonded) ligand. The crystal size distribution is estimated as 100% <30 micron, mean size <10 micron.

Example I-12

Preparation of Silicon Phthalocyanine-di-(triethanolamine)

This photobleach has the general structure shown in Structure E-1 of Example I-1 supra. However, bonded ligands, X, which occupy axial positions, are derived from triethanolamine and have the structure:

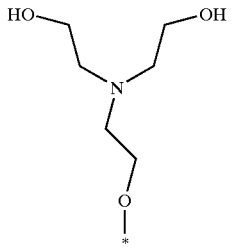

wherein the asterisk (*) shows the point of bonding to Si(PC). A mixture of the photobleach precursor silicon phthalocyanine dihydroxide (0.25 g, 0.44 mmole), the ligand triethanolamine (10 g, 67 mmole, anhydrous, Aldrich) and xylenes (175 mL) is heated to reflux over 1.5 hr. The solution is continued at reflux for 2 hr. while water is removed by azeotropic distillation. The reaction mixture is then cooled and the solvent removed in vacuo. The resulting crude oil is dissolved in dimethylformamide (50 mL) and is added to water (800 mL) over about 0.5 hr. A blue solid forms. This is collected by filtration, and dried under vacuum at 80°. This is the photobleach compound silicon phthalocyanine-di-(triethanolamine), in solid microcrystalline form, without significant amounts of excess (nonbonded) ligand. The crystal size distribution is estimated as 100% <30 micron, mean size <10 micron. UV-Vis (dimethylformamide) $\lambda_{max}$=670, $\epsilon$=228,300.

Example I-13

Synthesis of Silicon Phthalocyanine bis (Tetrahydroxypropyl Ethylenediamine)

This photobleach has the general structure shown in Structure E-1 of Example I-1 supra. Bonded ligands, X, which occupy axial positions, have the structure:

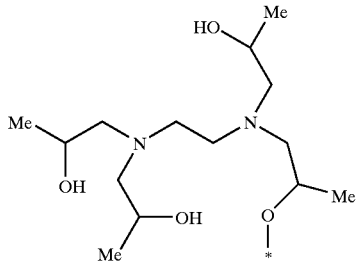

wherein the asterisk (*) shows the valence or point of attachment to Si(PC).

Assemble a 500 mL, 3-necked round bottom flask fitted with a Dean-Stark drying apparatus, reflux condenser, argon inlet, magnetic stir bar, internal thermometer, Thermowatch™ temperature control means and heating mantle. Charge with 300 mL xylenes (0.1 L xylenes/mmol silicon phthalocyanine dihydroxide) and the ligand Quadrol™ polyol (common chemical name: tetrahydroxypropyl ethylenediamine, BASF, 56 g, 192 mmol). Under argon and with magnetic stirring, heat to xylene reflux temperature (approximately 140° C.) for 4 hours during which time the solvent and starting material are dried via azeotropic distillation with xylenes. Allow the reaction to cool to room temperature over 16 hours under argon. Add the photobleach precursor silicon phthalocyanine dihydroxide (1.7 g, 3 mmol, Aldrich) to the reaction. Return the reaction to reflux for 4 hours during which time water is removed via azeotropic distillation with xylenes. The reaction mixture is a green/blue solution with some dark solids collected on the flask walls. Cool the reaction mixture to room temperature. Transfer the solution to a 1-liter, 1-necked round bottom flask and remove xylenes via the rotary evaporator. Dilute the resulting green/blue oil with 200 mL methylene chloride. Wash the methylene chloride solution three times with aqueous sodium chloride (200 mL, 10 wt. %.) Discard aqueous washes. Concentrate the organic layer on a rotary evaporator resulting in an aqua blue oil. Remove final traces of solvent from the sample by vacuum drying (using a vacuum pump) at 80° C. for 16 hours with magnetic stirring. Final product is a highly viscous aqua blue liquid. Sample is analyzed by proton NMR in deuterated chloroform and the percent silicon is measured via AAS. Final recovery is 35.7 g. This is the photobleach compound Silicon Phthalocyanine bis(tetrahydroxypropyl ethylenediamine), as an oil containing excess ligand. The content of the photobleach compound in the oil is consistent with an Si content (activity) of 8.0 wt %.

Example I-14

Photobleach System Consisting Essentially of a PEG-4000 Blend with Silicon Phthalocyanine bis(1 PO/OH Glycerol Propoxylate) and Nonbonded Ligand, Glycerol Propoxylate To a glass jar is added a 15.0 g sample, in the form of an oil, of silicon phthalocyanine bis(1 PO/OH glycerol propoxylate) having an activity of 16.8 wt % (the remainder is nonbonded ligand, glycerol propoxylate) followed by 79.4 g of melted PEG-4000 polymer. The polymer is melted on a hot plate at 70° C. The mixture is stirred with a magnetic bar with heating for 5 minutes to vive a homogeneous solution and is then cooled to room temperature. The resulting blue solid is ground to a powder and is ready for use. The final composition of the photobleach delivery system is: Photobleach compound 2.7%, Glycerol propoxylate nonbonded ligand 13.2%, PEG-4000 polymer 84.1%.

Example I-15

Isolation of Solid Silicon Phthalocyanine bis(Glycerol Propoxylate)

For comparison with Example I-1 wherein the photobleach compound silicon phthalocyanine bis(glycerol propoxylate) is obtained as an oil having present nonbonded ligand, this photobleach compound can be isolated as a solid. The present example illustrates conversion to the solid.

Charge a 12-liter, 1-necked round bottom flask, fitted with a magnetic stirrer and argon inlet, with 7.05 g of the photobleach silicon phthalocyanine bis(glycerol propoxylate) containing excess glycerol propoxylate ligand (prepared comparably to Example I-1). Dilute with 7 L deionized water and stir under argon for 1 hour. Collect the water insoluble material by vacuum filtration and allow to air dry in the hood overnight. Recovery is 0.95 g. The photobleach compound has solid form and has been substantially freed from nonbonded ligand. The solid is still somewhat tacky. Additional material remains on the flask wall. To determine the amount of photobleach remaining in the flask, tare the flask, rinse with methylene chloride to remove all remaining product, allow to dry and reweigh. The difference in the weight of the flask accounts for 0.28 g of additional silicon phthalocyanine bis(glycerol propoxylate). Total recovery is 1.23 g or 17.5%. Total isolated yield is 66.1% based on 1.0 g (1.74 mmol) of silicon phthalocyanine bis(hydroxide) starting material. Conventional crystallizations can be used to further improve the quality.

Example I-16

Laundry Persistence Test

The laundry persistence test is used to determine if a photobleach system as defined herein is persistent under conditions which model laundering. Critical is that an acceptable photobleach system must be able to at least partially survive the presence of detersive surfactant without unacceptably disintegrating and releasing the photobleach compound. The detersive surfactant ("test surfactant" as referred to elsewhere herein) can be varied, preferred for this test are one or more of:

- sodium linear alkylbenzene sulfonate (commercial, detergent grade)
- sodium mid-chain branched alkylbenzenesulfonate *
- sodium mid-chain branched alkyl sulfate *

(* See the disclosures of biodegradably branched surfactants elsewhere herein for references to these materials.)

Prepare a solution containing sodium sulfate 1200 ppm, sodium carbonate 500 ppm, detersive surfactant (e.g., NaLAS, 800 ppm) and water hardness of 10 U.S. grains per U.S. gallon and pH of about 10. Stir for 10 min. at ambient temperature. Filter though 0.45 micron Teflon to remove any precipitated hardness. Add 10,000 ppm of a photobleach delivery system to be tested (for example, product of Example I-14) forming a dispersion. The structures in the solution are observed using dynamic light scattering, for example by means of a Brookhaven Instruments Corp. BI9000 correlator. Examination of acceptable photobleach delivery systems, for example the photobleach delivery system of Example I-14, demonstrate persistence of structures having photobleach and polymer in the presence of the detersive surfactant. In the case of unacceptable photobleach delivery systems, in contrast, the polymer dissolves completely and the photobleach is entrained in surfactant micelles. In the present test, the use of dynamic light scattering may be further complemented by other techniques, such as freeze fracture transmission electron microscopy and cryo-transmission electron microscopy.

Example I-17

Laundry Deposition Test

The laundry deposition test is used to demonstrate codeposition of polymer and photobleach onto a test fabric from a photobleach delivery system. The presence of detersive surfactant ("test surfactant" as referred to elsewhere herein) is included, as in the laundry persistence test.

Polymer. $^{14}C$ radiolabelled water-soluble polymer is used to show polymer and photobleach co-deposit on fabrics. Typically the test involves preparing a photobleach delivery system according to the invention using $^{14}C$. radiolabelled water-soluble polymer. The photobleach delivery systems in the test generally use about 3 wt. % photobleach, for example as prepared in the above examples I-1 through I-13 and 97 wt. % of the water-soluble polymer. The polymer is melted and mixed with the photobleach to form the photobleach delivery system. When the water-soluble polymer is solid at room temperature, the photobleach delivery system is ground using a pestle and mortar after cooling. The photobleach delivery system is then added in increasing concentrations to a solution prepared as for the laundry persistence test. containing white cotton knit fabric. Polymer deposition is measured using conventional detection of the radiolabelled material as a function of polymer concentration in the wash test solution.

Photobleach: Photobleach deposition is measured two ways 1) by fluorescence techniques and 2) by extraction. A Perkin-Elmer Luminescence Spectrometer LS50B is used for the measurements. Fluorescence measurements are done directly on fabrics which were washed with photobleach containing detergent. Extractions are done with dimethylformamide (DMF) and a quantitative photobleach deposition is obtained from Beer Lambert calibration plots of photobleach absorption/fluorescence versus concentration.

Codeposition

For all preferred photobleach delivery systems according to the invention, the deposition of polymer as detected by the radiolabel, and of photobleach as detected by the fluorescence and/or extraction techniques in the experiment, increase together, preferably linearly, showing the two co-deposit together.

Comparisons

For photobleach delivery systems not in accordance with the invention, there is no convincing evidence of codeposition. For example, when using hydrophilic or water-soluble photobleaches such as sulfonated zinc phthalocyanines (not in accordance with the invention) and unsuitable polymers (especially water-soluble polymers which dissolve completely in the test solution liberating all the photobleach), then photobleach deposition occurs from its solution, but there is no convincing evidence of codeposition of polymer. (Note also that when a water-swellable but water-insoluble polymer is used, codeposition may occur, but the codeposited photobleach and polymer do not then show the photobleaching efficacy of the present compositions.)

Detergent Composition Examples

Non-limiting examples of detergent compositions according to this invention are as follows. The detergent compositions each make use of a photobleach delivery system in the form of a photoactive mixture taken from those tabulated below:

| PDS # | A | B | C | D | E | F | G | H | I | J | K | L | M | N | O |
|---|---|---|---|---|---|---|---|---|---|---|---|---|---|---|---|
| PBC | I-1 | I-2 | I-3 | I-4 | I-5 | I-6 | I-7 | I-8 | I-9 | I-10 | I-11 | I-12 | I-13 | I-1 | I-16 |
| WSP | WSP 1 | WSP 2 | WSP 3 | WSP 1 | WSP 2 | WSP 3 | WSP 1 | WSP 2 | WSP 3 | WSP 1 | WSP 2 | WSP 3 | WSP 1 | WSP 2 | WSP 3 |
| % PBC | 3 | 3 | 4 | 0.1 | 5 | 10 | 15 | 5 | 1 | 0.5 | 3 | 5 | 3 | 4 | 1 |
| % NL | 13 | 10 | 0 | 19.9 | 15 | 10 | 5 | 45 | 39 | 29.5 | 0 | 0 | 20 | 0 | 1 |
| % WSP | 84 | 87 | 96 | 80 | 80 | 80 | 80 | 50 | 60 | 70 | 97 | 95 | 77 | 96 | 98 |

In these tables the abbreviations are:
PDS = Photobleach Delivery System No. (Used in Detergent Composition Examples)
PBC = Photobleach compound (may contain nonbonded ligand, depending on synthesis example number e.g., I-1–I17)
WSP = Water-soluble polymer
WSP1 = PEG having Molecular Weight $M_n$ = 4,000 (Aldrich)
WSP2 = PEG having Molecular Weight $M_n$ 10,000 (Aldrich)
WSP3 = PVP having Molecular Weight $M_n$ 10,000 (Aldrich)
% PBC = percentage by weight of photobleach compound excluding nonbonded ligand in the photobleach system
% NL = percentage by weight of nonbonded ligand in the photobleach system
% WSP = percentage by weight of water-soluble polymer in the photobleach system In each case, the photobleach delivery system is prepared by mixing the components, for example using a procedure analogous to that of Example I-14. Note that if desired, nonbonded ligand can be added to the photoactive mixture at any point. One such sequence is to first prepare the photobleach compound from photobleach precursor and a first quantity of ligand, then to mix this with water-soluble polymer, then to adjust the level of nonbonded ligand. Likewise amount of nobonded ligand can be adjusted downwards, if needed, by gently heating the photoactive mixture under high vacuum.

In the detergent composition examples which follow, each example of a formulated detergent composition is numbered F-#, e.g., F-1, F-2, F-3 . . .

Examples

Simple Laundry Detergent Compositions Having Granular Form

| Ingredients | weight % F-1 Photobleach Delivery System PDS # A 0.01 | F-2 PDS # A-N 0.10 | F-3 PDS # A-N 0.20 | F-4 PDS # A-N 0.30 |
|---|---|---|---|---|
| Detersive surfactant Sodium $C_{11}$ Linear Alkylbenzene Sulfonate | 15 | 30 | 20 | 25 |
| Detersive surfactant $C_{24}E_5$ or $C_{45}E_{5-7}$ nonionic | 0 | 1 | 1 | 1 |
| Detersive surfactant $C_{12}$ alkyldimethylammonium chloride | 0.5 | 1 | 0.5 | 0 |
| Builder Sodium Tripolyphosphate | 15 | 35 | 22 | 0 |
| Builder Zeolite Na A (1–10 micron) | 0 | 0 | 0 | 30 |
| Builder Sodium Carbonate Anhydrous | 10 | 10 | 15 | 15 |
| Dispersant Sokalan ® CP5 (BASF) | 2 | 2 | 0 | 2 |
| Antiredeposition agent Carboxymethyl Cellulose | 0 | 0.1 | 1 | 1 |
| Brightener Tinopal ® CBS-X (CIBA) | 0.1 | 0 | 0 | 0 |
| Brightener Mixture (CIBA) | 0 | 0.1 | 0.1 | 0 |

-continued

Simple Laundry Detergent Compositions Having Granular Form

| Ingredients | weight % F-1 Photobleach Delivery System PDS # A 0.01 | F-2 PDS # A-N 0.10 | F-3 PDS # A-N 0.20 | F-4 PDS # A-N 0.30 |
|---|---|---|---|---|
| Soil Release Agent[1] | 0.2 | 0.2 | 0 | 0.3 |
| Enzyme Savinase ® 6.0T (Novo) | 0 | 0.6 | 0.5 | 0.6 |
| Enzyme BAN ® 300T Novo) | 0 | 0.1 | 0.5 | 0.6 |
| Enzyme Lipolase ® 100T Novo) | 0 | 0 | 0.2 | 0.3 |
| Enzyme Carezyme ® 5T Novo) | 0 | 0.2 | 0.2 | 0.3 |
| Bleach Sodium Perborate Monohydrate | 0 | 0 | 3.0 | 5.0 |
| Bleach Activator Nonanoyloxybenzene sulfonate, Na salt | 0 | 0 | 2.0 | 3.0 |
| Moisture + Sodium Sulfate + Perfume + Miscellaneous | Balance to 100 | Balance to 100 | Balance to 100 | Balance to 100 |

[1]. Soil Release Agent according to U.S. Pat. 5.415,807 Gosselink et al., issued May 16, 1991.

Examples

Laundry Detergent Composition Having Bar Form

| Ingredients | F-5 Weight % Photobleach Delivery System PDS# A-N 0.01 | F-6 PDS# A-N 0.1 | F-7 PDS# A-N 0.2 | F-8 PDS# 0.3 |
|---|---|---|---|---|
| $C_{12}$ Linear alkyl benzene sulphonate | 30 | 20 | 10 | 30 |
| $C_{12}$ alkyl sulfate | 0 | 10 | 20 | 0 |
| Phosphate (as sodium tripolyphosphate) | 7 | 0 | 20 | 7 |
| Sodium carbonate | 10 | 20 | 10 | 15 |
| Sodium pyrophosphate | 0 | 14 | 0 | 7 |

-continued

Laundry Detergent Composition Having Bar Form

| Ingredients | F-5 | F-6 | F-7 | F-8 |
|---|---|---|---|---|
| | Weight % Photobleach Delivery System | | | |
| | PDS# A-N 0.01 | PDS# A-N 0.1 | PDS# A-N 0.2 | PDS# 0.3 |
| Coconut monoethanolamide | 0 | 2 | 1 | 2 |
| Glycerine | 1 | 0 | 0 | 0 |
| Zeolite Na A | 0 | 0 | 0 | 5 |
| Carboxymethylcellulose | 0.05 | 0.5 | 0.1 | 0.2 |
| Polyacrylate (m.w. 1400) | 0 | 0.1 | 0.1 | 0.2 |
| Sodium percarbonate | 0 | 0 | 0 | 15 |
| Sodium perborate | 5 | 0 | 5 | 0 |
| Protease | 0 | 0.1 | 0.2 | 0.3 |
| $CaSO_4$ | 0 | 5 | 0 | 1 |
| CaO | 2 | 0 | 2 | 0 |
| Na silicate | 2 | 0 | 0 | 0 |
| $MgSO_4$ | 0 | 0 | 3 | 1 |
| DTPMP | 0 | 0.5 | 0.9 | 0 |
| Miscellaneous/Moisture Balance to | 100 | 100 | 100 | 100 |

Examples

Laundry Detergent Compositions having Low Aqueous Liquid form

| Ingredients | % (wt.) Formula Range F-9 |
|---|---|
| Photobleach Delivery System PDS # A-N | 0.01–0.3 |
| BPP[2] | 5–25 |
| 1,2-octanediol | 0.1–7.0 |
| $MgAE_1S$ | 0.01–0.8 |
| $MgAE_{6.5}S$ | 0.01–0.8 |
| $C_{12}$ Dimethyl Amine Oxide | 0.01–0.8 |
| PEMULEN[3] | 0.05–0.20 |
| perfume | 0.01–1.5 |
| water | Balance to 100 |
| pH range from about 6 to about 8 | |

2. Other co-solvents which can be used herein together with the BPP, MPP. EPP and PPP primary solvents include various glycol ethers, including materials marketed under trademarks such as Carbitol, methyl Carbitol, butyl Carbitol, propyl Carbitol, hexyl Cellosolve, and the like. If desired, and having due regard for safety and odor for in-home use, various conventional chlorinated and hydrocarbon dry cleaning solvents may also be used. Included among these are 1,2-dichloroethane, trichloroethylene, isoparaffins, and mixtures thereof.

3. As disclosed in U.S. Pat. Nos. 4,758,641 and 5,004,557, such polyacrylates include homopolymers which may be crosslinked to varying degrees, as well as non-crosslinked. Preferred herein are homopolymers having a molecular weight in the range of from about 100,000 to about 10,000,000, preferably 2000,000 to 5,000,000.

Fabrics are laundered using the foregoing compositions, typically at usage concentrations of from about 10 ppm to about 10,000 ppm. The fabrics are dried in the presence of light, preferably natural sunlight, to achieve improved photobleaching benefits.

Examples

Laundry Detergent Compositions

The following abbreviations are used for cleaning product adjunct materials:

| Type | Name/ Acronym | Description |
|---|---|---|
| P | PDS | Photobleach Delivery System according to tabulations hereinabove |
| S | $C_{xy}$ Amine Oxide | $C_{xy}$ Alkyl dimethylamine N-Oxide RN(O) $Me_2$ of given chainlength $C_{xy}$ where average total carbon range of the non-methyl alkyl moiety R is from 10+x to 10+y |
| S | $C_{xy}$ Betaine | Alkyldimethyl Betaine having an average total carbon range of alkyl moiety from 10+x to 10+y |
| S | $C_{xy}$ MES | Alkyl methyl ester sulfonate, Na salt having an average total carbon range of alkyl moiety from 10+x to 10+y |
| S | $C_{xy}$ NaPS | Paraffin sulfonate, Na salt having an average total carbon range of alkyl moiety from 10+x to 10+y |
| S | $C_{xy}$ SAS | Secondary alkyl sulfate, Na salt having an average total carbon range of alkyl moiety from 10+x to 10+y |
| S | $C_{xy}AS$ | Alkyl sulfate, Na salt or other salt if specified having an average total carbon range of alkyl moiety from 10+x to 10+y |
| S | $C_{xy}E_z$ | Commercial linear or branched alcohol ethoxylate (not having mid-chain methyl branching) and having an average total carbon range of alkyl moiety from 10+x to 10+y average z moles of ethylene oxide |
| S | $C_{xy}E_zS$ | Alkyl ethoxylate sulfate, Na salt (or other salt if specified) having an average total carbon range of alkyl moiety from 10+x to 10+y and an average of z moles of ethylene oxide |
| S | Fatty Acid (C12/14) | $C_{12}$–$C_{14}$ fatty acid |
| S | Fatty Acid (C12/18) | $C_{12}$–$C_{18}$ fatty acid |
| S | Fatty Acid (C14/18) | $C_{14}$–$C_{18}$ fatty acid |
| S | Fatty Acid (RPS) | Rapeseed fatty acid |
| S | Fatty Acid (TPK) | Topped palm kernel fatty acid |
| S | LAS | Linear Alkylbenzene Sulfonate (e.g., C11.8, Na or K salt) |
| S | LMFAA | $C_{12}$–$C_{14}$ alkyl N-methyl glucamide |
| S | $MBA_xE_y$ | Mid-chain branched primary alkyl ethoxylate (average total carbons = x; average EO = y) |
| S | $MBA_xE_yS$ | Mid-chain branched or modified primary alkyl ethoxylate sulfate, Na salt (average total carbons = x;average EO = y) |
| S | $MBA_yS$ | Mid-chain branched primary alkyl sulfate, Na salt (average total carbons = y) |
| S | MLAS | mid-chain branched alkylbenzene sulfonate, sodium salt |
| S | QAS | $R_2.N^+(CH_3)_x((C_2H_4O)yH)z$ with $R_2 = C_8$–$C_{18}$ x + z = 3, x = 0 to 3, z = 0 to 3, y = 1 to 15. |
| S | TFA | $C_{16}$–$C_{18}$ alkyl N-methyl glucamide |
| NSA | Amylase | Amylolytic enzyme of activity 60KNU/g sold by NOVO Industries A/S under the tradename Termamyl 60T. Alternatively, the amylase is selected from: Fungamyl ®; Duramyl ®; BAN ®; and α amylase enzymes described in WO95/26397 and in co-pending application by Novo Nordisk PCT/DK96/00056. |
| NSA | APA | $C_8$–$C_{10}$ Alkyl amidopropyldimethyl amine |
| NSA | Bicarbonate | Anhydrous sodium bicarbonate with a particle size distribution between 400 μm and 1200 μm |
| NSA | Borax | Na tetraborate decahydrate |
| NSA | BPP | Butoxy - propoxy - propanol |
| NSA | Brightener 1 | Disodium 4,4'-bis(2-sulphostyryl)biphenyl |
| NSA | Brightener 2 | Disodium 4,4'-bis(4-anilino-6-morpholino-I.3.5-triazin-2-yl)amino) stilbene-2:2'-disulfonate |
| NSA | $CaCl_2$ | Calcium chloride |

-continued

| Type | Name/ Acronym | Description |
|---|---|---|
| NSA | Carbonate | $Na_2CO_3$ anhydrous, 200 μm–900 μm |
| NSA | Cellulase | Cellulolytic enzyme, 1000 CEVU/g, NOVO, Carezyme ® |
| NSA | Citrate | Trisodium citrate dihydrate, 86.4%, 425 μm–850 μm |
| NSA | Citric Acid | Citric Acid, Anhydrous |
| NSA | CMC | Sodium carboxymethyl cellulose |
| NSA | Diamine | Alkyl diamine, e.g., 1,3 propanediamine, Dytek EP, Dytek A, (Dupont) or selected from: dimethyl aminopropyl amine; 1,6-hexane diamine; 1,3 propane diamine; 2-methyl 1,5 pentane diamine; 1,3-pentanediamine; 1 methyl-diaminopropane; 1,3 cyclohexane diamine; 1,2 cyclohexane diamine |
| NSA | Dimethicone | 40(gum)/60(fluid) wt. Blend of SE-76 dimethicone gum (G.E Silicones Div.)/dimethicone fluid of viscosity 350 cS. |
| NSA | DTPA | Diethylene triamine pentaacetic acid |
| NSA | DTPMP | Diethylene triamine penta (methylene phosphonate), Monsanto (Dequest 2060) |
| NSA | Endolase ® | Endoglucanase, activity 3000 CEVU/g, NOVO |
| NSA | EtOH | Ethanol |
| NSA | Formate | Formate (Sodium) |
| NSA | HEDP | 1,1-hydroxyethane diphosphonic acid |
| NSA | Hydrotrope | selected from sodium, potassium, Magnesium, Calcium, ammonium or water-soluble substituted ammonium salts of toluene sulfonic acid, naphthalene sulfonic acid, cumene sulfonic acid, xylene sulfonic acid. |
| NSA | Isofol ® 12 | X12 (average) Guerbet alcohols (Condea) |
| NSA | Isofol ® 16 | C16 (average) Guerbet alcohols (Condea) |
| NSA | Lipase | Lipolytic enzyme, 100kLU/g, NOVO, Lipolase ®. Alternatively, the lipase is selected from: Amano-P; M1 Lipase ®; Lipomax ®; D96L - lipolytic enzyme variant of the native lipase derived from Humicola lanuginosa as described in U.S. Ser. No. 08/341,826; and the Humicola lanuginosa strain DSM 4106. |
| NSA | LOBS | C12 oxybenzenesulfonate, sodium salt |
| NSA | MA/AA | Copolymer 1:4 maleic/acrylic acid, Na salt, avg. mw, 70,000. |
| NSA | MEA | Monoethanolamine |
| NSA | $MgCl_2$ | Magnesium chloride |
| NSA | MnCAT | Macrocyclic Manganese Bleach Catalyst as in EP 544,440 A or, preferably, use [Mn(Bcyclam)$Cl_2$] wherein Bcyclam = 5,12-dimethyl-1.5.8.12-tetraaza-bicyclo[6.6.2] hexadecane or a comparable bridged tetra-aza macrocycle |
| NSA | NaDCC | Sodium dichloroisocyanurate |
| NSA | NaOH | Sodium hydroxide |
| NSA | NaSKS-6 | Crystalline layered silicate of formula δ-$Na_2Si_2O_5$ |
| NSA | NaTS | Sodium toluene sulfonate |
| NSA | NOBS | Nonanoyloxybenzene sulfonate, sodium salt |
| NSA | PAA | Polyacrylic Acid (mw = 4500) |
| NSA | PAE | Ethoxylated tetraethylene pentamine |
| NSA | PAEC | Methyl quaternized ethoxylated dihexylene triamine |
| NSA | PB1 | Anhydrous sodium perborate bleach of nominal formula $NaBO_2.H_2O_2$ |
| NSA | PEG | Polyethylene glycol (e.g., mw = 4600) (added separate from photobleach system, e.g. to clarify a syndet bar) |
| NSA | PE1 | Ethoxylated polyethyleneimine, water-soluble |
| NSA | Percarbonate | Sodium Percarbonate of nominal formula $2Na_2CO_3.3H_2O_2$ |
| NSA | PG | Propanediol |
| NSA | Protease | Proteolytic enzyme, 4KNPU/g, NOVO, Savinase ®®. Alternatively, the protease is selected from: Maxatase ®; Maxacal ®; Maxapem 15 ®; subtilisin BPN and BPN'; Protease B; Protease A; Protease D; Primase ®; Durazym ®; Opticlean ®;and Optimase ®; and Alcalase ®. |
| NSA | Silicate | Sodium Silicate, amorphous ($SiO_2$:$Na_2O$; 2.0 ratio) |
| NSA | Silicone antifoam | Polydimethylsiloxane foam controller + siloxane-oxyalkylene copolymer as dispersing agent; ratio of foam controller:dispersing agent = 10:1 to 100:1; or, combination of fumed silica and high viscosity polydimethylsiloxane (optionally chemically modified) |
| NSA | Solvent | nonaqueous solvent e.g., hexylene glycol, see also propylene glycol |
| NSA | SRP 1 | Sulfobenzoyl end capped esters with oxyethylene oxy and terephthaloyl backbone |
| NSA | SRP 2 | Sulfonated ethoxylated terephthalate polymer |
| NSA | SRP 3 | Methyl capped ethoxylated terephthalate polymer |
| NSA | STPP | Sodium tripolyphosphate, anhydrous |
| NSA | Sulfate | Sodium sulfate, anhydrous |
| NSA | TAED | Tetraacetethylenediamine |
| NSA | Zeolite A | Hydrated Sodium Aluminosilicate, $Na_{12}(AlO_2SiO_2)_{12}.27H_2O$; 0.1–10 μm |
| NSA | Zeolite MAP | Zeolite (Maximum aluminum P) detergent grade (Crosfield) |

Type:

P=Photobleach Delivery System of the invention

S=Detersive surfactant

NSA=Nonsurfactant detergent adjunct

Typical ingredients often referred to as "minors" can include perfumes, dyes, pH trims etc.

The following example is illustrative of the present invention, but is not meant to limit or otherwise define its scope. All parts, percentages and ratios used are expressed as percent weight unless otherwise noted.

Examples

The following laundry detergent compositions are prepared in accordance with the invention:

| | F-10 | F-11 | F-12 | F-13 | F-14 | F-15 |
|---|---|---|---|---|---|---|
| | Photobleach Delivery System PDS # (A-N) | | | | | |
| | 0.01 | 0.1 | 0.2 | 0.3 | 0.1 | 0.01 |
| Any Combination of: $C_{45}AS$ $C_{45}E1S$ or $C_{23}E_3S$ LAS $C_{26}$ SAS $C_{47}$ NaPS $C_{48}$ MES $MBA_{16.5}S$ $MBA_{15.5}E2S$ MLAS | 0.1–25 | 1–17.5 | 0.5–22 | 1–30 | 1–25 | 1–35 |
| QAS | 0–2 | 0–2 | 0–2 | 0–2 | 0–4 | 1 |
| $C_{23}E_{65}$ or $C_{45}E_7$ | 1.5 | 1.5 | 1.5 | 1.5 | 0–4 | 0–4 |
| Zeolite A | 27.8 | 0 | 27.8 | 27.8 | 20–30 | 0 |
| Zeolite MAP | 0 | 27.8 | 0 | 0 | 0 | 0 |
| STPP | 0 | 0 | 0 | 0 | 0 | 5–30 |
| PAA | 2.3 | 2.3 | 2.3 | 2.3 | 0–5 | 0–5 |
| Carbonate | 27.3 | 27.3 | 27.3 | 27.3 | 20–30 | 0–30 |
| Silicate | 0.6 | 0.6 | 0.6 | 0.6 | 0–2 | 0–6 |
| PB1 | 1.0 | 1.0 | 0–10 | 0–10 | 0–10 | 0–20 |
| NOBS | 0–1 | 0–1 | 0–1 | 0.1 | 0.5–3 | 0–5 |
| LOBS | 0 | 0 | 0–3 | 0 | 0 | 0 |
| TAED | 0 | 0 | 0 | 2 | 0 | 0–5 |
| MnCAT | 0 | 0 | 0 | 0 | 2 ppm | 0–1 |
| Protease | 0–0.5 | 0–0.5 | 0–0.5 | 0–0.5 | 0–0.5 | 0–1 |
| Cellulase | 0–0.3 | 0–0.3 | 0–0.3 | 0–0.3 | 0–0.5 | 0–1 |

-continued

| | F-10 | F-11 | F-12 | F-13 | F-14 | F-15 |
|---|---|---|---|---|---|---|
| | Photobleach Delivery System PDS # (A-N) | | | | | |
| | 0.01 | 0.1 | 0.2 | 0.3 | 0.1 | 0.01 |
| Amylase | 0–0.5 | 0–0.5 | 0–0.5 | 0–0.5 | 0–1 | 0–1 |
| SRP 1 or SRP 2 | 0.4 | 0.4 | 0.4 | 0.4 | 0–1 | 0–5 |
| Brightener 1 or 2 | 0.2 | 0.2 | 0.2 | 0.2 | 0–0.3 | 0–5 |
| PEG | 1.6 | 1.6 | 1.6 | 1.6 | 0–2 | 0–3 |
| Silicone Antifoam | 0.42 | 0.42 | 0.42 | 0.42 | 0–0.5 | 0–1 |
| Sulfate, Water, Minors | to 100% | to 100% | to 100% | to 100% | to 100% | to 100% |
| Density (g/L) | 400–700 | 600–700 | 600–700 | 600–700 | 600–700 | 450–750 |

Examples

The following laundry detergent compositions suitable for hand-washing soiled fabrics are prepared in accord with the invention:

| | F-16 | F-17 | F-18 | F-19 |
|---|---|---|---|---|
| | Photobleach Delivery System PDS #A-N | | | |
| | 0.01 | 0.1 | 0.1 | 0.3 |
| MLAS, LAS or MLAS/LAS mixed | 18 | 22 | 18 | 22 |
| STPP | 20 | 40 | 22 | 28 |
| Silicates | 15 | 10 | 15 | 10 |
| Protease | 0 | 0 | 0.3 | 0.3 |
| Perborate | 0 | 0 | 0 | 10 |
| Sodium Chloride | 25 | 15 | 20 | 10 |
| Brightener | 0–0.3 | 0.2 | 0.2 | 0.2 |
| Moisture & Minors | ---Balance--- | | | |

Examples

Cleaning Product Compositions

The following liquid laundry detergent compositions are prepared in accordance with the invention. Abbreviations are as used in the preceding Examples.

| | F-20 | F-21 | F-22 | F-23 | F-24 |
|---|---|---|---|---|---|
| | Photobleach Delivery System PDS # A-N | | | | |
| | 0.01 | 0.1 | 0.2 | 0.3 | 0.1 |
| MLAS or LAS (prefer MLAS) | 1–7 | 7–12 | 12–17 | 17–22 | 1–35 |
| Any combination of: $C_{25}$E1.8-2.5S MBA15.5E1.8S MBA15.5S C25AS (linear to high 2-alkyl) C47 NaPS C26 SAS C26 MES | 15–21 | 10–15 | 5–10 | 0–5 | 0–25 |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |

-continued

| | F-20 | F-21 | F-22 | F-23 | F-24 |
|---|---|---|---|---|---|
| | Photobleach Delivery System PDS # A-N | | | | |
| | 0.01 | 0.1 | 0.2 | 0.3 | 0.1 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2 | 2 | 2 | 2 | 0–14 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Hydrotrope or NaTS | 2.3 | 2.3 | 2.3 | 2.3 | 0–4 |
| Formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PEI | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.7 | 7.7 | 7.7 | 7.7 | 6–9.5 |

Examples

Non-limiting examples of a bleach-containing nonaqueous liquid laundry detergent composition are prepared as follows:

| | F-25 | F-26 |
|---|---|---|
| | Wt. % | Range (% wt.) |
| | Photobleach Delivery System PDS # A–N | |
| Component | 0.1 | 0.3 |
| Liquid Phase | | |
| MLAS | 15 | 1–35 |
| LAS | 12 | 0–35 |
| C24E5 | 14 | 10–20 |
| Solvent or Hexylene glycol | 27 | 20–30 |
| Perfume | 0.4 | 0–1 |
| Solid Phase | | |
| Protease | 0.4 | 0–1 |
| Citrate | 4 | 3–6 |
| PB1 | 3.5 | 2–7 |
| NOBS | 8 | 2–12 |
| Carbonate | 14 | 5–20 |
| DTPA | 1 | 0–1.5 |
| Brightener 1 | 0.4 | 0–0.6 |
| Silicon antifoam | 0.1 | 0–0.3 |
| Minors | Balance to 100 | Balance to 100 |

The resulting anhydrous heavy duty liquid laundry detergent provides excellent stain and soil removal performance when used in normal fabric laundering operations.

What is claimed is:

1. A photobleaching system comprising:

a) from about 0.01% to about 30% by weight, of a phthalocyanine photobleach having the formula:

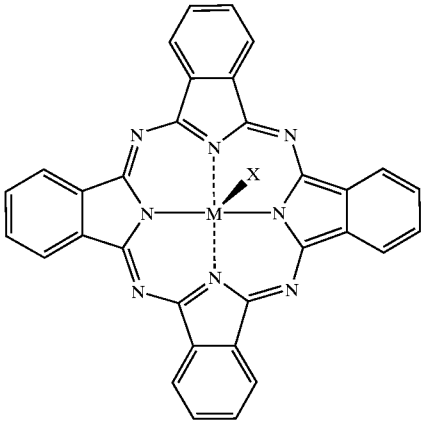

or the formula:

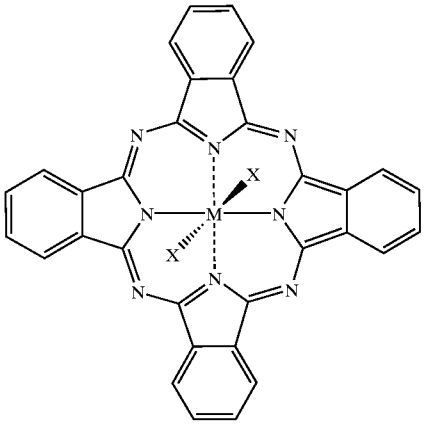

wherein M is a metal or metalloid selected from the group consisting of Si, Al, Ga, Ge, Sn, and mixtures thereof, X and X' are each independently ligands having the formula;

i)

$$-O(C_3H_6O)_a-CH_2\overset{(OC_3H_6)_bOH}{\overset{|}{C}}HCH_2-(OC_3H_6)_cOH;$$

ii)

$$HO(C_3H_6O)_a-CH_2\overset{(OC_3H_6)_bO-}{\overset{|}{C}}HCH_2-(OC_3H_6)_cOH;$$

iii) and mixtures thereof;

wherein the indices a, b, and c each independently have the value from 0 to 16 such that the sum of a+b+c results in the ligands X and X' having an average molecular weight of from 200 to 1000 daltons; and b) from about 30% to about 99.9% by weight of one or more carriers selected from the group consisting of:

i) polyethylene glycols having an average molecular weight of from 500 to 1,000,000 daltons;

ii) glycerol propoxylates having an average molecular weight of from 200 to 1000 daltons;

iii) and mixtures thereof.

2. A system according to claim 1 wherein the sum of a+b+c is from 4 to 9.

3. A system according to claim 1 wherein M is Si.

4. A system according to claim 1 wherein said carrier is a glycerol propoxylate.

5. A system according to claim 1 wherein said carrier has a solubility parameter of from 15 $Mpa^{1/2}$ to 42 $Mpa^{1/2}$.

6. A system according to claim 1 wherein said carrier has a molecular weight of from 1,000 to 10,000 daltons.

7. A detergent composition having an improved photobleach delivery system said detergent composition comprising a) from about 0.015 ppm to about 0.5% by weight, of a phthalocyanine photobleach having the formula:

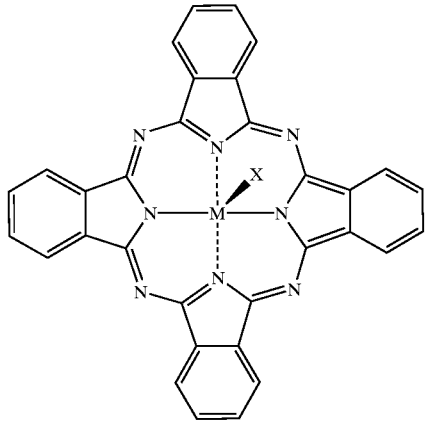

or the formula:

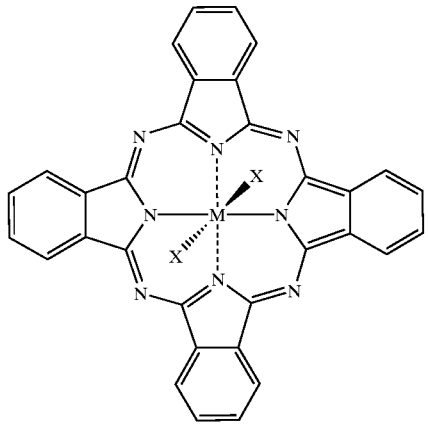

wherein M is a metal or metalloid selected from the group consisting of Si, Al, Ga, Ge, Sn, and mixtures thereof; X and X' are each independently ligands having the formula;

i)

$$-O(C_3H_6O)_a-CH_2\overset{(OC_3H_6)_bOH}{\overset{|}{C}}HCH_2-(OC_3H_6)_cOH;$$

ii)

$$HO(C_3H_6O)_a-CH_2\overset{(OC_3H_6)_bO-}{\overset{|}{C}}HCH_2-(OC_3H_6)_cOH;$$

iii) and mixtures thereof;

wherein the indices a, b, and c each independently have the value from 0 to 16 such that the sum of a+b+c results in the ligands X and X' having an average molecular weight of from 200 to 1000 daltons; and b) from 0.01% to about 25% of one or more carriers selected from the group consisting of:

i) polyethylene glycols having an average molecular weight of from 500 to 1,000,000 daltons;

ii) glycerol propoxylates having an average molecular weight of from 200 to 1000 daltons;

iii) and mixtures thereof:

c) from 0.1% to 95% by weight, of one or more detersive surfactants: and d) the balance additional carriers and adjunct ingredients.

8. A laundry detergent composition comprising a photobleaching system according to claim 1.

* * * * *